US007789430B2

(12) United States Patent
Wittmeyer, Jr. et al.

(10) Patent No.: US 7,789,430 B2
(45) Date of Patent: Sep. 7, 2010

(54) EASEL PAD

(75) Inventors: Larry Wittmeyer, Jr., Lake Lotawana, MO (US); Lance M. Sparks, Topeka, KS (US)

(73) Assignee: Cardinal Brands, Inc., Lawrence, KS (US)

( * ) Notice: Subject to any disclaimer, the term of this patent is extended or adjusted under 35 U.S.C. 154(b) by 295 days.

(21) Appl. No.: 11/110,524

(22) Filed: Apr. 20, 2005

(65) Prior Publication Data

US 2006/0237620 A1 Oct. 26, 2006

(51) Int. Cl.
*B42D 3/00* (2006.01)

(52) U.S. Cl. ..... 281/29; 281/15.1; 281/33; 281/31; 248/441

(58) Field of Classification Search ..... 248/441, 248/447.1; 281/29, 33, 31, 15.1; 428/40.1, 428/42.2, 42.3; 434/84; 40/107
See application file for complete search history.

(56) References Cited

U.S. PATENT DOCUMENTS

| | | | | | |
|---|---|---|---|---|---|
| 736,810 | A | | 8/1903 | Wynans | |
| 1,176,786 | A | | 3/1916 | Stranders | |
| 1,386,700 | A | | 8/1921 | Gilbert | |
| 2,024,984 | A | | 12/1935 | Bradley | |
| 2,486,840 | A | * | 11/1949 | Harris | 281/44 |
| 2,606,041 | A | * | 8/1952 | Misiak, Jr. | 281/30 |
| 2,726,835 | A | * | 12/1955 | Hummel | 248/459 |
| 2,738,061 | A | | 3/1956 | Roth | |
| 3,188,113 | A | | 6/1965 | Cross | |
| 3,778,324 | A | * | 12/1973 | Lavigne | 156/257 |
| 4,002,237 | A | | 1/1977 | Nichols | |
| 4,066,171 | A | | 1/1978 | Fowlie | |
| 4,105,182 | A | * | 8/1978 | Jacobson | 248/459 |
| 4,318,471 | A | | 3/1982 | Hutton | |
| 4,395,056 | A | * | 7/1983 | Sferragatta | 281/31 |
| 5,007,192 | A | | 4/1991 | Hochberg | |
| 5,334,094 | A | * | 8/1994 | Armbruster et al. | 462/17 |
| 5,351,992 | A | | 10/1994 | Chilson | |
| 5,697,518 | A | * | 12/1997 | Callahan, Jr. | 221/34 |
| 5,788,080 | A | * | 8/1998 | Sill et al. | 206/554 |
| 5,874,144 | A | * | 2/1999 | Kumar et al. | 428/40.1 |
| 5,996,778 | A | | 12/1999 | Shih | |
| 6,102,199 | A | | 8/2000 | Ho | |
| 6,299,119 | B1 | | 10/2001 | Dunning | |
| 6,382,864 | B1 | | 5/2002 | Moor | |
| 6,536,803 | B2 | | 3/2003 | Masson | |
| 6,543,615 | B2 | * | 4/2003 | Lake | 206/371 |
| 6,612,771 | B1 | * | 9/2003 | Su | 402/57 |
| 6,682,798 | B1 | * | 1/2004 | Kiraly | 428/40.1 |
| 7,094,454 | B2 | * | 8/2006 | Kuo et al. | 428/40.1 |
| 7,360,960 | B2 | * | 4/2008 | Hite | 401/131 |
| 2001/0040207 | A1 | | 11/2001 | Richardson | |
| 2004/0229193 | A1 | * | 11/2004 | Wittmeyer et al. | 434/84 |
| 2006/0125229 | A1 | * | 6/2006 | Ray | 281/15.1 |

* cited by examiner

*Primary Examiner*—J. Allen Shriver
*Assistant Examiner*—Todd M. Epps
(74) *Attorney, Agent, or Firm*—Stinson Morrison Hecker LLP

(57) ABSTRACT

An easel pad having a ledge for supporting an instrument, such as a marker, or a separate smaller notepad in the cover of the easel pad.

23 Claims, 12 Drawing Sheets

EASEL PAD

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention is directed to an easel pad, and more particularly to an easel pad having a ledge integrated into the cover that is adapted to hold writing instruments, such as makers, and other devices commonly used with easel pads.

DESCRIPTION OF RELATED ART

Easel pads typically include a multiplicity of large aligned flexible sheets (i.e., typically paper sheets) in a stack which are attached together along an edge or margin of the sheets. Easel pads are large in size and usually include a stiff cover or back card upon which the stack of sheets is mounted. See generally U.S. Pat. No. 5,299,833 and U.S. Design Pat. No. 329,872, which are incorporated by reference.

Easel pads are used in a variety of ways. For example, easel pads are sometimes used as drawing pads for budding artists. In the commercial setting, easel pads are often used during meetings to record lists of items or ideas generated during the meeting. Suitable writing instruments, such as markers, are usually used to write on the sheets of the easel pad.

During use, easel pads are sometimes placed on an easel stand. The easel stand may include a stand ledge upon which the easel pad rests. This stand ledge is also useful for supporting markers, other writing instruments, block erasers, and the like. Other easel stands also have separate storage clips attached thereto for holding markers and other accessories.

Many easel pads are not used in conjunction with an easel stand, such as those easel pads that are hung on a wall, and therefore an easel stand ledge is not available to the user. In addition, the use of separate clips and the like to hold markers are often awkward to use because the clip must typically be manually opened with one hand before the writing instrument can be inserted or removed with the other hand. Accordingly, there remains a need to provide an easel pad which itself is adapted to easily hold markers and other instruments commonly used with easel pads.

BRIEF SUMMARY OF THE INVENTION

An object of the present invention is to provide an easel pad which is adapted to hold markers and other writing instruments commonly used with easel pads.

Another object of the present invention is to provide an easel pad which permits the user to easily remove a writing instrument.

A further object of the present invention is to provide an easel pad having a cover with a die-cut pattern for forming a support ledge for holding a marker or other writing instrument.

Yet another object of the present invention is to provide an easel pad with a ledge useful for holding a separate smaller stack of flexible sheets, such as those self-adhesive paper pads commonly used in office settings.

Other objects and advantages of the present invention will be apparent from the following description and accompanying drawings.

BRIEF DESCRIPTION OF THE DRAWINGS

FIG. 2 is a perspective view of a portion of the easel pad shown in FIG. 1, whereby the front cover panel is folded to create a support ledge adapted to hold writing instruments, such as markers and the like.

FIG. 4 is front perspective view of the easel pad shown in FIG. 3, whereby the front cover panel is folded to create a support ledge adapted to hold writing instruments, such as markers and the like.

FIG. 6 is a front perspective view of the easel pad shown in FIG. 5, whereby the front cover panel is folded to create two support ledges, each ledge adapted to hold writing instruments, such as markers and the like.

FIG. 8 is a front perspective view of the easel pad shown in FIG. 7, whereby the front cover panel is folded to create two support ledges adapted to hold writing instruments, such as markers and the like.

DETAILED DESCRIPTION OF THE PREFERRED EMBODIMENTS

Figure 1:
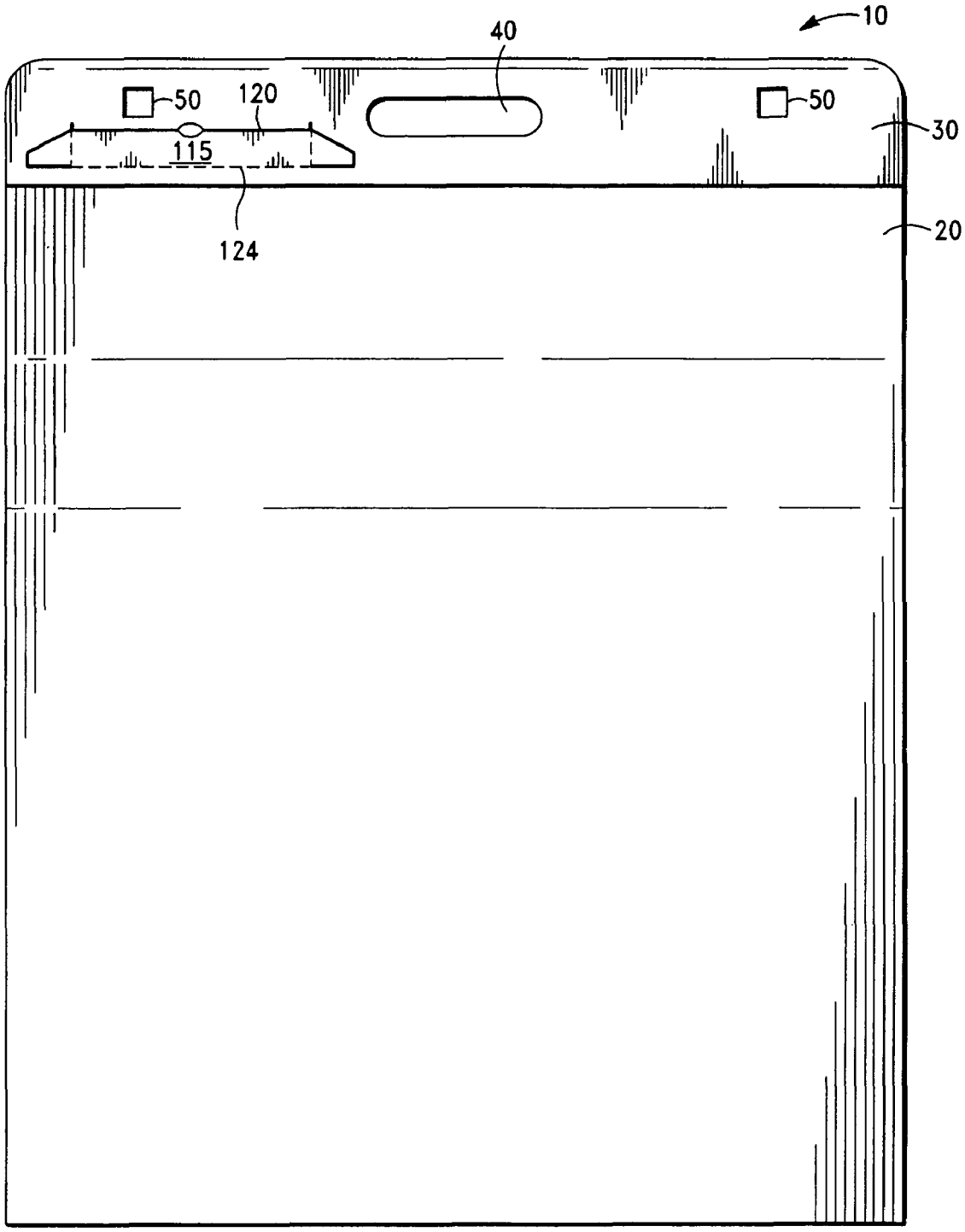
FIG. 1 is a plan view of an easel pad having a die-cut pattern in the easel pad cover in accordance with a first embodiment of the present invention.

Turning now to the drawings, various easel pads 10 in accordance with the present invention are shown. In general, the easel pad 10 is comprised of a stack of flexible sheets 20, preferably paper, positioned in a first major plane of the easel pad and bound to one another along an edge or margin 22, usually the top margin of the pad, to hold the sheets 20 together in a pad-type arrangement. Staples, fasteners, adhesive (hot melt, fugitive, repositional, etc.) or other suitable pad binding methods are conventionally provided to secure the sheets to one another along the margin 22.

In the preferred embodiment, repositional adhesive is applied along the back sides of the sheets to bind the sheets together. Numerous products using repositionable sensitive adhesive are commercially available, as are the adhesive compositions themselves. The repositionable adhesive is preferably a repositionable microsphere pressure-sensitive adhesive. The adhesive is generally applied in the form of a strip adjacent the bound margin of the sheet, so that the individual sheets may be removed from the easel pad and adhered to another supporting surface, such as a wall. To facilitate the removal of each sheet from the pad, a separation or perforation line (not shown) optionally extends across each sheet between the binding and repositional adhesive. In addition, a release strip (not shown) may be provided over the adhesive on the sheets. The release strip may comprise a separate strip of release material or a folded portion of the sheet.

The sheets 20 of the easel pad may be any suitable shape or size, but are preferably rectangular or square in shape. Typically, the sheets range in size from about 1.5 to three feet wide by about two to four feet high, and are more preferably about two feet wide by about three feet high.

The sheets 20 of the present invention are made of any suitable substrate. The sheet material is preferably comprised of paper, vellum, or plastic film materials, such as polyethylene, polypropylene and polyester, including MYLAR® available from Dupont. Most preferably, the flexible sheet material is comprised of paper. Also, as is known in the art, the flexible sheet material may include various coatings, such as a primer coating or release coating.

The easel pad 10 of the present invention includes a cover 30 comprised of relatively stiff material, such as those cover materials conventionally used in easel pads. Typically, the cover material is such that it can be repeatedly bent and folded without fracturing. Examples of suitable cover materials include heavy gauge paper, cardboard, polyethylene, polypropylene, vinyl, nylon, rubber, leather, various impregnated or laminated fibrous materials, various plasticized materials, and the like, and combinations of such materials (e.g., cardboard with a plastic lamination).

As discussed more fully below, the cover 30 of the easel pad 10 of the present invention is modified to include a support ledge that is well suited for holding markers, erasers, and other instruments when the easel pad is in an upright position. When the stack of flexible sheets are positioned in a first major plane (e.g., substantially vertical or upright plane), the support ledge extends from the cover in a second plane. The second plane is preferably substantially perpendicularly to the first major plane (e.g., horizontal plane) so that the instrument may rest on the support ledge without falling from the ledge. The substantially planar support ledge of the easel pad enables the writer or drawer to quickly and easily obtain the instrument from the pad, and deposit the instrument back on the easel pad when the writer or drawer is finished using the instrument.

The support ledge is integrated into any suitable cover 30 design conventionally used with easel pads, such as those covers comprising a bottom cover panel 32, a front cover panel 34, or both panels. In most instances, it is desirable to construct the cover 30 of the easel pad with a bottom cover panel 32 that extends along the length of the bottommost sheet in the stack of flexible sheets 20 as generally illustrated in FIG. 1. The bottom cover panel 32 provides stiff support for the flexible sheets 20, which facilitates the positioning of the easel pad 10 on an easel stand. In addition, the bottom cover panel 32 provides a more stable and level sheet writing surface during use.

In other instances, it may be desirable to construct a cover 30 having both a bottom cover panel 32 and a front cover panel 34. The cover 30 may be formed by folding a unitary piece of cover material along a fold-line and then securing the stack of sheets between the "v"-shaped portion defined by the bottom cover panel 32 and front cover panel 34. The bottom cover panel 32 and front cover panel 34 may alternatively be formed of separate pieces of cover material which are adhered together at a margin using conventional binding means.

The cover 30 may optionally include one or more handles 40 useful for carrying the easel pad 10. The handle 40 is usually formed in the top and center portion of the easel pad. For covers 30 comprising only a bottom cover panel 32, the handle 40 usually comprises an elongated handle opening, such as hole or a flap (see, e.g., FIG. 9), in the bottom cover panel 32 of the easel pad.

Figure 2:
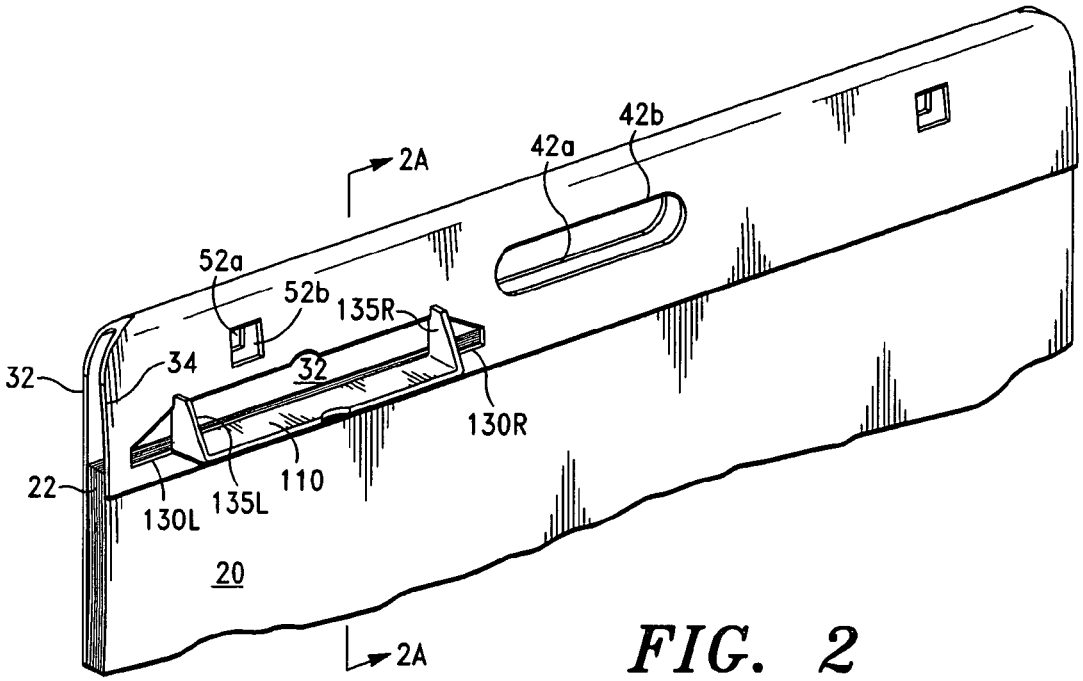

For easel pads 10 including both a bottom cover panel 32 and a front cover panel 34, the handle 40 is typically formed by creating two complementary handle openings 42*a*, 42*b* in the cover material. Either or both complementary handle openings 42*a*, 42*b* may be formed by completely removing a portion of the cover 30 to form a hole. Either or both complementary handle openings 42*a*, 42*b* may also comprise a foldable flap 44 formed by cutting the cover 30 in a substantially "u"-shaped configuration. For example, FIG. 2 illustrates two complementary handle openings 42*a*, 42*b*, each comprised of an elongated hole in the back panel 32 and another elongated hole in the front cover panel 34 of the cover. As another example, as shown in FIGS. 3A to 4A, complementary handle opening 42*a* comprises a hole in the bottom cover panel 32 while complementary handle opening 42*b* comprises a foldable flap 44 formed in the front cover panel 34 by making a "u"-shaped cut and creating an upper fold-line 45 at the top of the "u." When the flap 44 is folded upwardly along fold-line 45, the complementary handle opening 42*b* is created During use, the foldable flap 44 in the front cover panel 34 is usually folded upwardly so that it is positioned either: (1) against the bottom cover panel 32 in a plane substantially parallel to the plane of the bottom cover panel 32, or (2) against the front cover panel 34 in a plane substantially parallel to the plane of the front cover panel 34. In the former case, the foldable flap 44 helps secure the bottom cover panel 32 and front cover panel 34 together.

The cover 30 may also optionally include one or more hanging openings 50 adapted to receive hanging pegs or hooks that are commonly used in conjunction with easel pad stands or other suitable hanging devices on the hanging surface. The hanging opening 50 can be any suitable shape or size (e.g., circular, square, elongated slots, and the like). Preferably, the cover contains a set of hanging openings 50 which are positioned on the right and left sides of the pad near the top of the pad. The hanging openings 50 may be formed by completely removing a portion of the cover to create a hole or by creating a foldable flap in the cover.

For easel pads 10 including both a bottom cover panel 32 and a front cover panel 34, each hanging opening 50 is typically formed by creating two complementary hanging openings 52*a*, 52*b* (e.g., holes or flaps) in the cover material. Together, the complementary hanging openings 52*a*, 52*b* are aligned such that they are adapted to receive the hanging pegs, hooks, and the like.

As illustrated in the following embodiments, the cover 30 of the easel pad 10 is cut and/or scored using conventional die-cutting techniques to create a blank for forming a support ledge. The cover 30 is then folded outwardly from the major plane of the easel pad to form the support ledge. The ledge is useful for supporting markers and other instruments of various shapes and sizes commonly used with easel pads. The die-cut pattern for forming the support ledge may optionally be integrated with the handle, hanging openings, and/or a second support ledge. In addition, the cover may be die-cut to provide for the placement of a separate smaller note pad within the cover such that the sheets of the note pad may be dispensed to the user.

While several embodiments are discussed below, those skilled in the art will readily appreciate that various modifications may be made, and the invention is not limited to the specific forms or arrangement of parts and steps described herein.

First Embodiment

FIGS. 1, 1A, 2, and 2A illustrate an easel pad 10 in accordance with a first embodiment of the present invention. The easel pad 10 comprises a stack of flexible sheets 20 and a cover 30 having both a bottom cover panel 32 and a front cover panel 34. In addition, the cover 30 includes a handle 40 made of a pair of complementary handle openings 42*a*, 42*b* comprised of elongated holes, as well as two lateral hanging openings 50, each hanging opening 50 comprised of a pair of complementary holes 52*a*, 52*b* adapted to receive hanging pegs or hooks.

Figure 1A:
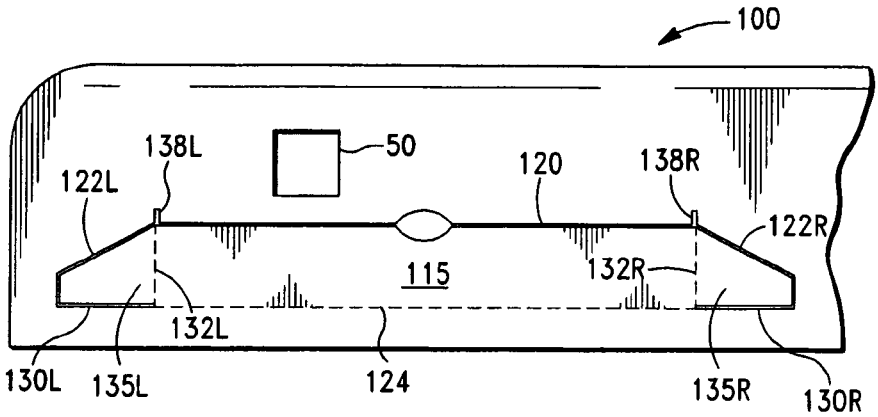
FIG. 1A is an enlarged plan view of a portion of the cover of the easel pad illustrated in FIG. 1.

FIGS. 1 and 1A show a first blank 100 for creating a support ledge 110 in accordance with the first embodiment of the present insertion. The blank 100 includes a flap 115 formed by making a generally upside-down "u"-shaped cut in the cover 30. In general, the flap 115 comprises an upper cut 120, two side cuts 122R, 122L, and a lower fold-line 124. As shown in FIG. 1, the lower fold-line 124 is substantially horizontal when the easel pad is in a substantially upright or vertical position. FIG. 2 shows that when the flap 115 is folded downwardly along lower fold-line 124 so that flap 115 is substantially perpendicular to the plane of the upright cover 30, it forms a horizontal support ledge 110 for holding a marker or other instrument, which can be easily accessed by the user.

As shown in FIG. 2, the foldable flap 115 extends outwardly from the major plane of the cover 30 so that a marker or other instrument placed on the support ledge 110 will not roll or fall off the ledge when the easel pad 10 is in an upright position. As such, it is preferable that support ledge 110 be positioned substantially perpendicular to the plane of the upright cover or be positioned at an upward angle, thereby making a "v" with the cover. In addition, the support ledge 110 may optionally include a lip (not shown) at the outer edge of the ledge 110 formed by making a fold near cut 120, the lip extending upward to help keep the marker from rolling off the support ledge 110 when the easel pad is in an upright position.

The blank 100 preferably includes additional cuts and/or folds that are used to stabilize the support ledge 110 in a removably fixed position. For example, as shown in FIG. 1A, adjacent and lateral to the lower fold-line 124, one or more lower cuts 130R, 130L are provided. When the cover is folded along fold-line 132R (which extends between the lower fold-line 124 and the upper cut 120), the blank creates a foldable stabilizing flap 135R. To help stabilize the support ledge 110, the stabilizing flap 135R is folded out along fold-line 132R so that the flap 135R is substantially perpendicular to the plane of the cover 30. The flap 135R then removably engages the cover 30, for example at the upper cut 120 or side cut 122R, to maintain the support ledge 110 in a removably fixed position. The flap 135R is also preferably removably inserted into a receiving slot 138R in the cover 30 for additional stability.

Similarly, when the cover is folded along fold-line 132L (which extends between the lower fold-line 124 and the upper cut 120), the blank creates a stabilizing flap 135L opposite the stabilizing flap 135R. To help stabilize the ledge 110, the flap 135L is folded out along fold-line 132L so that the flap 135L is no longer in the same plane as the cover 30. The flap 135L engages the cover 30 to help maintain the support ledge 110 in a removably fixed position. The flap 135L is also preferably inserted into a receiving slot 138L in the cover 30 for additional stability.

Figure 2A:
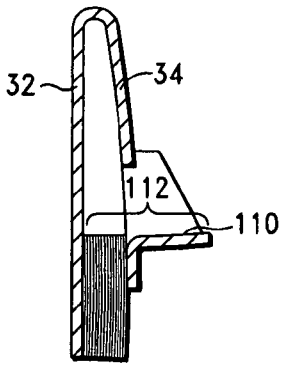
FIG. 2A is a cross-sectional view of the easel pad of FIG. 2 taken along line 2A-2A.

As shown in FIG. 2A, the edge of the stack of flexible sheets 20 is positioned within the cover 30 so that the edge is aligned with support ledge 110. Together the support ledge 110 and the edge of the stack of flexible sheets 20 comprise a composite support ledge 112 that are together useful for holding a marker or other instrument commonly used with the easel pad 10.

It will be readily apparent to those skilled in the art that the blank 100 is well-suited for incorporation in any suitable cover design for an easel pad. For example, although the blank 100 is illustrated in FIGS. 1, 1A, 2 and 2A in a cover 30 comprising both a bottom cover panel 32 and a front cover panel 34, the blank may alternatively be incorporated into a cover comprising a bottom cover panel 32 only that extends above or below the stack of flexible sheets (see, e.g., FIG. 9). However, it is preferable that blank 100 be formed in an easel pad 10 having a cover 30 comprising both a bottom cover panel 32 and a front cover panel 34, rather than a single panel. In such a case, the blank is most preferably formed in the front cover panel so that, as shown in FIGS. 2 and 2A, when the easel pad is placed in an upright position, bottom cover panel 32 serves as a vertical wall behind the front cover panel 34 in the area in which the support ledge 110 extends out of the plane of the front cover panel 34. Thus, the bottom cover panel 32 of the cover 30 helps prevent the marker or other instrument from rolling off the support ledge 110.

Second Embodiment

FIGS. 3, 3A, 3B, 4, and 4A illustrate an easel pad 10 in accordance with a second embodiment of the present invention. While only the top portion of the easel pad is shown in the figures, it will be appreciated that the remainder of the easel pad is constructed in a conventional manner. The easel pad 10 comprises a stack of flexible sheets 20 and a cover 30 having both a bottom cover panel 32 and a front cover panel 34. In addition, the cover 30 includes handle 40 comprised of a pair of complementary handle openings 42*a*, 42*b*, in which the bottom complementary handle opening 42*a* comprises an elongated slot in the bottom cover panel 32 and the front complementary handle opening 42*b* comprises a foldable flap 44 in the front cover panel 34. In addition, the cover 30 includes left and right hanging openings 50, each haning opening comprised of a pair of complementary hanging openings 52*a*, 52*b* (e.g., holes) adapted to receive hanging pegs, hooks, and the like.

Figure 3:
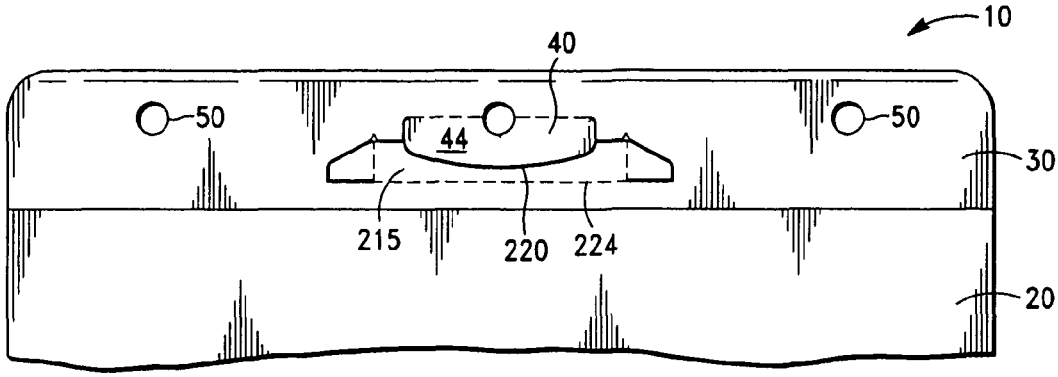
FIG. 3 is a plan view of the top portion of an easel pad having a die-cut pattern in the easel pad cover in accordance with a second embodiment of the present invention.
Figure 3A:
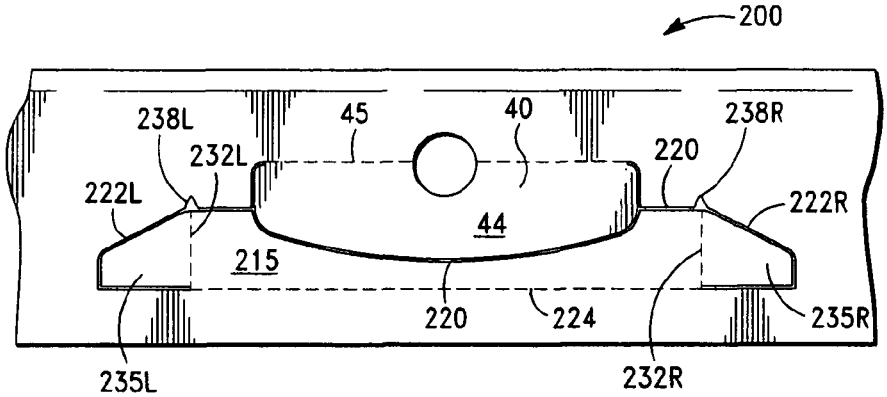
FIG. 3A is an enlarged plan view of a portion of the cover of the easel pad illustrated in FIG. 3.
Figure 3B:
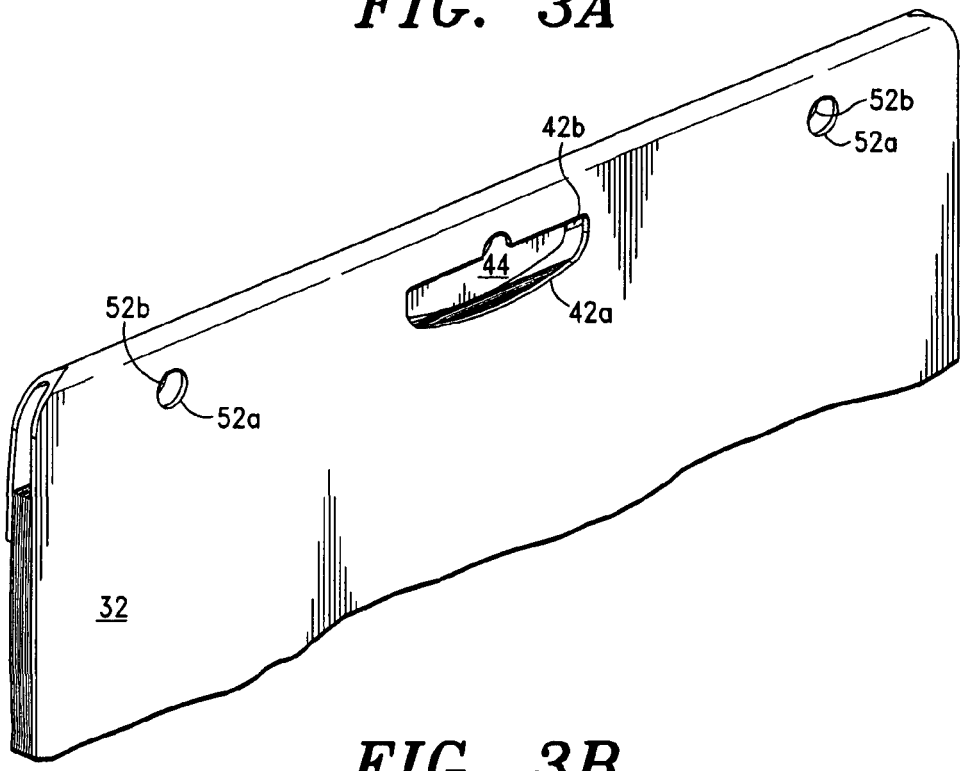
FIG. 3B is a back perspective view of a portion of the bottom cover panel of the easel pad cover shown in FIG. 3.

FIGS. 3, 3A, and 3B depict a blank 200 for creating a support ledge 210 in accordance with a second embodiment of the present invention. The blank 200 of the second embodiment is similar to the first embodiment, but the handle 40 is also integrated with the support ledge 210.

The support ledge 210 comprises a flap 215 formed by making a generally upside-down "u"-shaped cut in the cover 30. In general, the flap 215 has an upper cut 220, two side cuts 222R, 222L, and a lower fold-line 224. As shown in FIG. 3, it is preferable that the lower fold-line 224 be substantially horizontal when the easel pad is in a substantially upright or vertical position. When the flap 215 is folded downwardly along lower fold-line 224 so that flap 215 is substantially perpendicular to the plane of the vertical cover 30 (see FIG. 4), it forms a horizontal support ledge 210 for holding a marker or other instrument that can be easily accessed by the user.

As with the first embodiment, the second blank 200 preferably includes additional cuts and/or folds that are used to stabilize the support ledge 210. For example, adjacent to the lower fold-line 224, one or more lower cuts 230R, 230L are provided. When the cover is folded along fold-line 232R (which extends between the lower fold-line 224 and the upper cut 220), the blank creates a stabilizing flap 235R. To help stabilize the support ledge 210, the flap 235R is folded out along fold-line 232R so that the flap 235R is substantially perpendicular to the plane of the cover 30. The flap 235R engages the upper cut 220 or side cut 222R to maintain the support ledge 210 in a removably fixed position. The flap 235R is removably inserted into a receiving slot 238R in the upper cut 220 for additional stability.

Similarly, when the cover is folded along fold-line 232L (which extends between the lower fold-line 224 and the upper cut 220), the blank creates a stabilizing flap 235L opposite the stabilizing flap 235R. To help stabilize the ledge 210, the flap 235L is folded out along fold-line 232L so that the flap 235R is no longer in the same plane as the cover 30. The flap 235L engages the upper cut 220 to help maintain the support ledge 210 in a removably fixed position. The flap 235L is also preferably inserted into receiving slot 238L in the upper cut 220 for additional stability.

As discussed above, in the second embodiment, the handle 40 of the easel pad 10 is integrated with the die-cut pattern of the support ledge 210. That is, at least one of the cuts and/or folds that is used to form the support ledge 210 is also used to form part of the handle 40.

Figure 4:
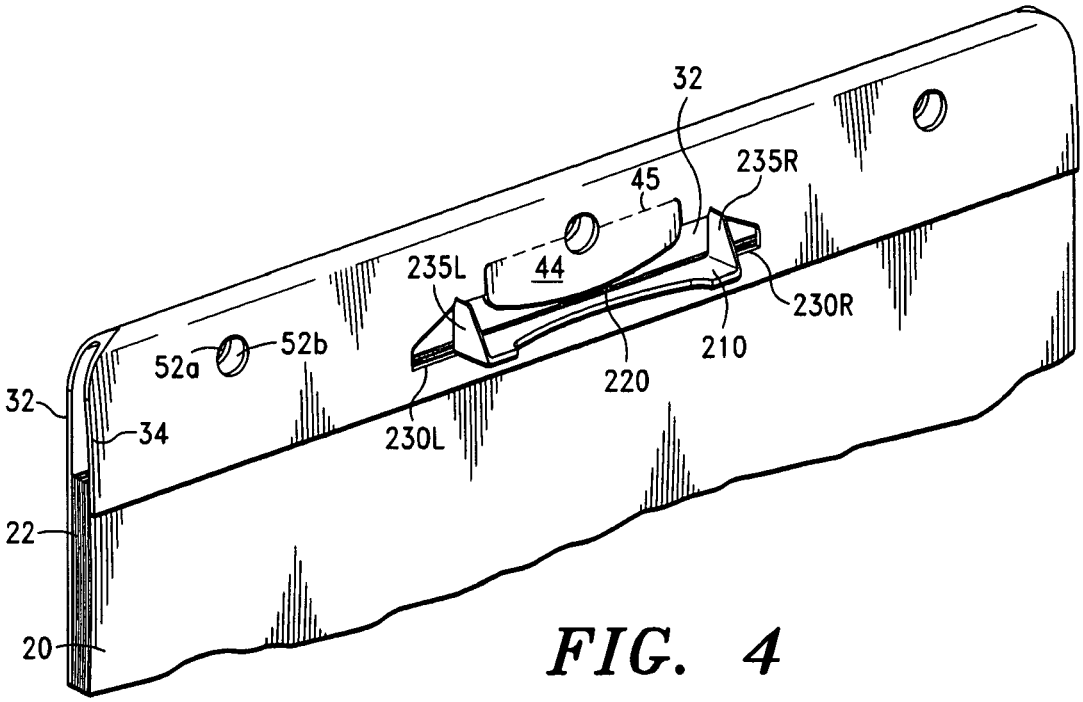
Figure 4A:
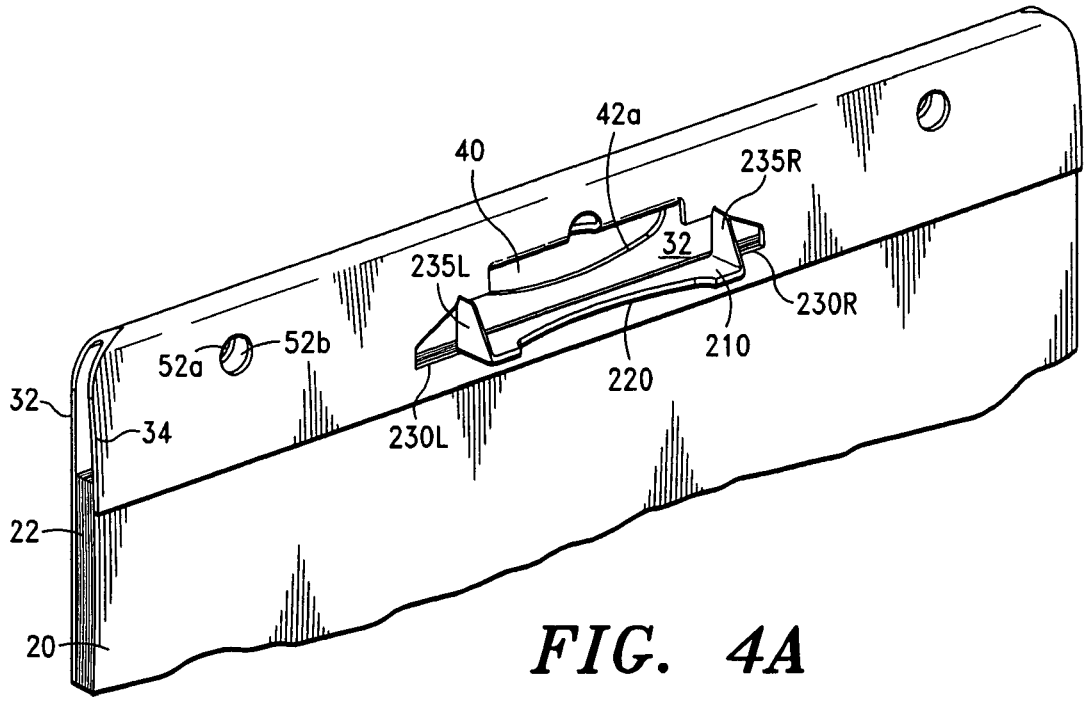
FIG. 4A is a another front perspective view of the easel pad shown in FIG. 3, whereby the front cover panel is folded to create a support ledge adapted to hold writing instruments, such as markers and the like, and the cover is also folded to form a handle in the pad.

More specifically, in the second embodiment, at least a portion of the upper cut 220 used to form the flap 215 of the support ledge 210 is also used to form part of a handle 40 in the cover 30. As shown in FIGS. 3A and 3B, the handle 40 comprises two complementary handle openings 42*a*, 42*b*. The first complementary handle opening 42*a* comprises an elongated hole 42*a* in the bottom cover panel 32. The second complementary handle opening 42*b* comprises a foldable flap 44 formed in the front cover panel by making a generally "u"-shaped cut and creating an upper fold line 45 at the top of the "u." At least a portion of the cut used to form the bottom of the "u" of foldable flap 44 comprises a portion of the upper cut 220 of the flap 215 used to form the support ledge 210. As depicted in FIG. 4A, when the foldable flap 44 is folded upwardly along fold-line 45, the handle 40 is formed.

The blank 200 having the support ledge 210 and handle 40 is formed in any suitable cover design. Preferably, the blank 200 is formed in an easel pad 10 having a cover 30 comprising both a bottom cover panel 32 and a front cover panel 34, rather than a single panel. As such, when the easel pad is placed in an upright position, the complementary handle opening 42*a* (e.g., hole or flap) in the bottom cover panel 32 is located so that the bottom cover panel 32 provides a vertical wall behind the front cover panel 34 in the area in which the support ledge 210 extends substantially perpendicularly from the plane of the front cover panel 34 (see FIGS. 4 and 4A). Thus, the bottom cover panel 32 helps prevent the marker or other instrument from rolling off the support ledge 210.

Although the handle 40 described in the second embodiment comprises a flap/hole combination, it will be readily apparent that the handle 40 may be formed from any suitable design. For example, the handle 40 may comprise a flap in the bottom cover panel and a hole in the front cover panel, a hole in the bottom cover panel and a flap in the front cover panel, a hole in the bottom cover panel and a hole in the front cover panel, or a flap in the bottom cover panel and a flap in the front cover panel. When the blank 200 comprises a handle having a hole in the front cover panel 34, a portion of the upper cut 220 used to form the flap 215 of the support ledge 210 is also used to form the hole of the handle 40.

Third Embodiment

FIGS. 5, 5A, 6, and 6A illustrate an easel pad 10 in accordance with a third embodiment of the present invention. Again, only the inventive part of the pad is in the figures. The easel pad 10 comprises a stack of flexible sheets 20 and a cover 30 having both a bottom cover panel 32 and a front cover panel 34. In addition, the cover 30 contains a handle 40 formed of a pair of complementary handle openings 42*a*, 42*b* made of circular holes, as well as two hanging openings 50, each comprised of a pair of complementary hanging openings 52*a*, 52*b* (e.g., holes) that are adapted to receive hanging pegs or hooks.

Figure 5:
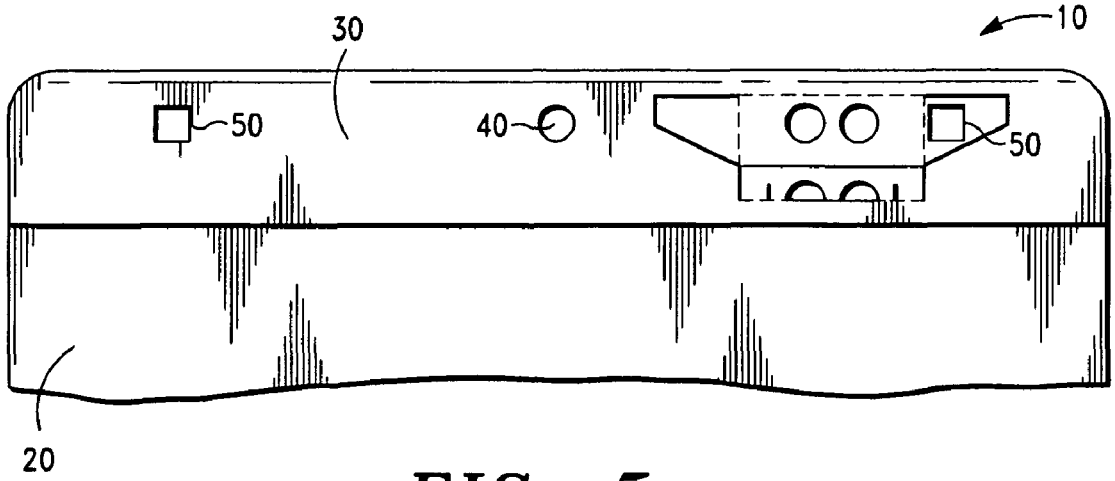
FIG. 5 is a plan view of the top portion of an easel pad having a die-cut pattern in the easel pad cover in accordance with a third embodiment of the present invention.
Figure 5A:
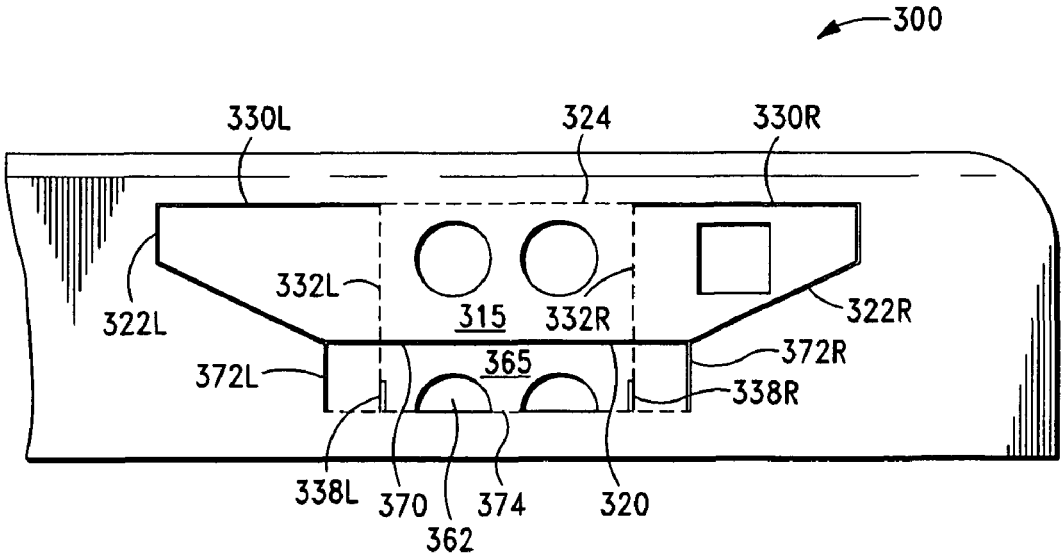
FIG. 5A is an enlarged plan view of a portion of the cover of the easel pad illustrated in FIG. 5.

FIGS. 5 and 5A illustrate a blank 300 for creating a support ledge 310 in accordance with the third embodiment of the present invention. In this embodiment, the cover includes a flap 315 formed by making a generally "u"-shaped cut in the front cover panel 34. In general, the flap 315 has an upper fold-line 324, two side cuts 322R, 322L, and a lower cut 320. When the flap 315 is folded upwardly along upper fold-line 324 so that flap 315 is substantially perpendicular to the plane of the cover 30, it forms a support ledge 310 for holding a marker or other instrument (see FIG. 6). Thus, when the easel pad 10 is placed in an upright position, the user can easily access the marker from the support ledge 310.

The blank 300 preferably contains additional cuts and/or folds that are used to stabilize the support ledge 310. For example, adjacent or near the upper fold-line 324, one or more upper cuts 330R, 330L are provided. When the cover is folded along fold-line 332R (which extends between the lower cut 320 and the upper fold-line 324), the blank creates a foldable stabilizing flap 335R. To help stabilize the support ledge 310, the flap 335R is folded out along fold-line 332R so that the flap extends out of the plane (e.g., substantially perpendicularly) of the cover 30. The flap 335R engages the cover to help maintain the support ledge 335 in a removably fixed position. The flap 335R is removably inserted into a receiving slot 338R in the cover 30 for additional stability.

Similarly, when the cover is folded along fold-line 332L (which extends between the upper fold-line 324 and the lower cut 320), the blank creates a stabilizing flap 335L opposite the stabilizing flap 335R. To help stabilize the ledge 310, the flap 335L is folded out along fold-line 332L so that the flap 335R is no longer in the same plane as the cover 30. The flap 335L engages the cover 30 to help maintain the support ledge 310 in a removably fixed position. The flap 335L is preferably inserted into a receiving slot 338L in the cover 30 for additional stability.

In the third embodiment, the blank 300 optionally contains additional cuts and/or folds used to create a second support ledge 360 below the support ledge 310. Although the first support ledge 310 and second support ledge 360 can be formed with independent cuts and folds, the blank 300 preferably integrates the die-cut pattern of the second ledge 360 with the die-cut pattern of the first support ledge 310. That is, at least one of the cuts and/or folds that is used to form the first support ledge 310 is also used to form part of the second support ledge 360.

The second support ledge 360 is generally constructed in a similar manner to the ledge 110 discussed above in conjunction with the first embodiment. More specifically, the second support ledge 360 is comprised of a flap 365 having an upper cut 370, two side cuts 372R, 372L, and a lower fold-line 374. That is, the flap 365 is formed by making a generally upside-down "u"-shaped cut in the cover 30. At least a portion of the upper cut 370 used to form the bottom of the "u"-shaped cut for lower flap 365 comprises a portion of the lower cut 320 used to form upper flap 315.

As shown in FIG. 5A, the lower fold-line 374 of the flap 365 is substantially horizontal when the easel pad 10 is in a partially upright or vertical position. When the flap 365 is folded downwardly along lower fold-line 374 so that flap 365 is folded out of the plane of the cover 30 (e.g., substantially perpendicular to the plane of the substantially vertical cover 30) (see FIG. 6), it forms a support ledge 360 for holding a marker or other instruments, which can be easily accessed by the user. As with the first support ledge 310, it is preferable that the second support ledge 360 be substantially horizontal when the easel pad 10 is in an upright position.

Figure 6:
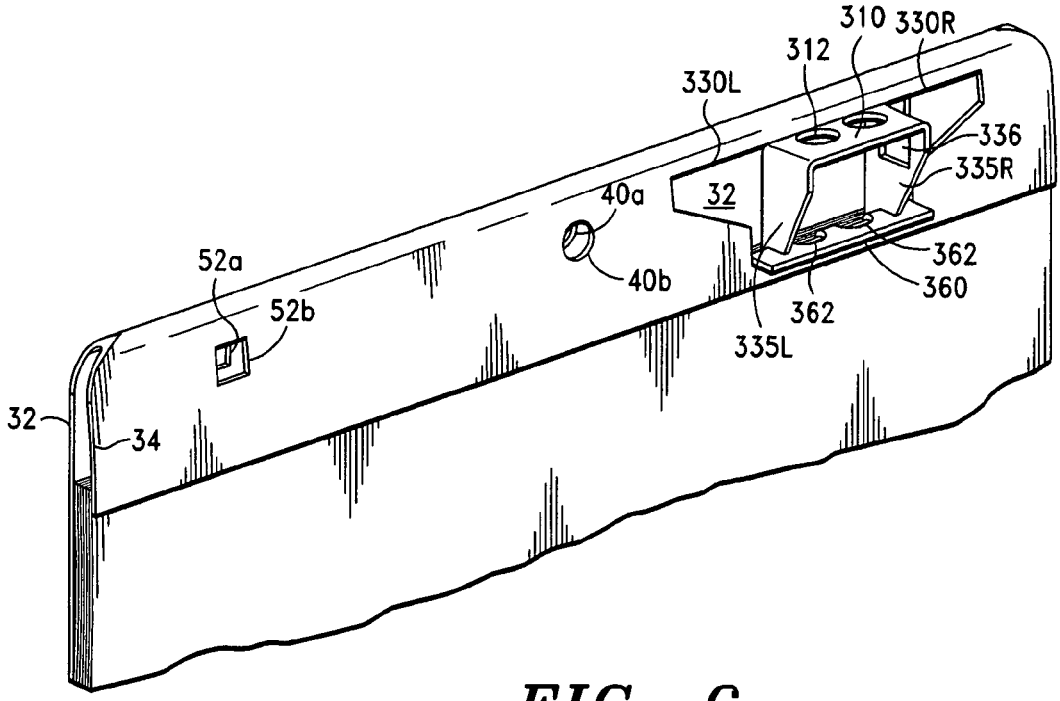

As shown in FIG. 6, the stabilizing flaps 335R, 335L are preferably removably inserted into receiving slots 338R, 338L in the second ledge 360 for additional stability. Thus, the blank 300 comprises one or more flaps 335R, 335L which function to stabilize both the first ledge 310 and the second ledge 360.

Figure 6A:
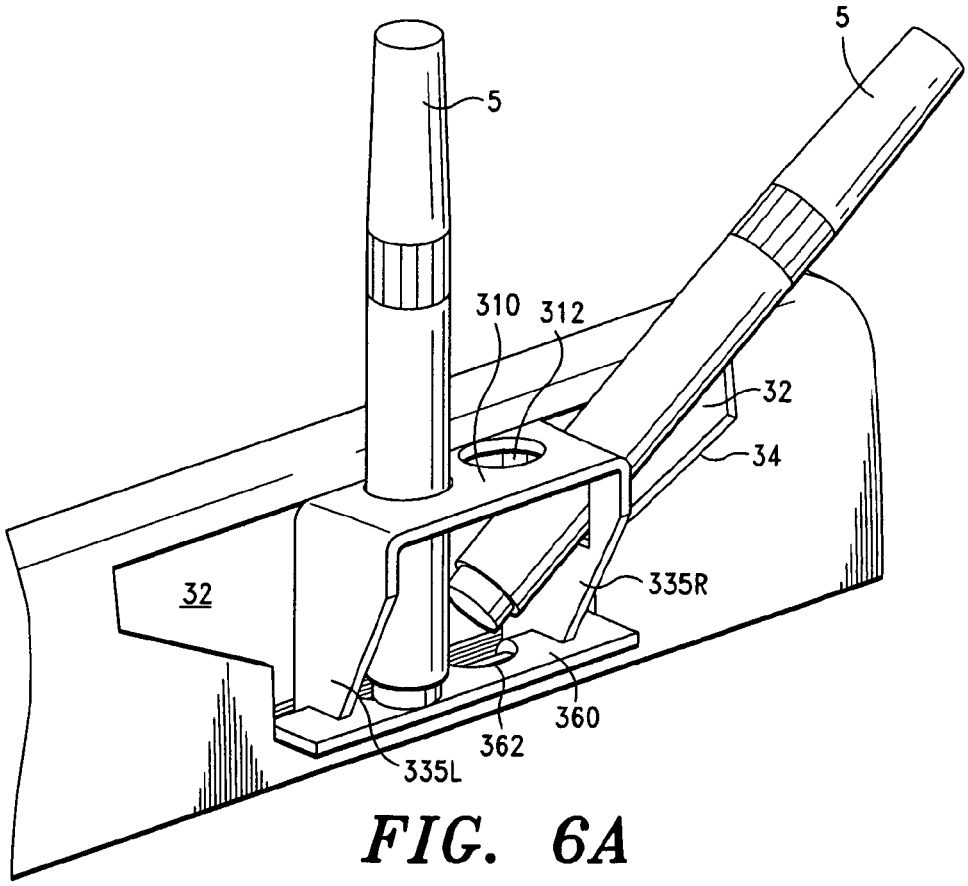
FIG. 6A is an enlarged front perspective view of the easel pad shown in FIG. 6, whereby two markers are held by the support ledges.

The first ledge 310 optionally contains one or more holes 312 for removably receiving a writing instrument or other elongated object in a substantially vertical position. As shown in FIG. 6A, the writing instruments 5 are inserted through the holes 312 and rest on the second ledge 360, which is positioned below the first ledge 310. The second ledge 360 may optionally include one or more smaller holes 362 for receiving a portion of the writing instrument or other elongated object. The smaller holes 362 are sized so that the elongated object is not permitted to fall through the smaller holes 362, but instead the smaller holes 362 retain the elongated object in a removably fixed position.

As shown in FIGS. 6 and 6A, the stabilizing flaps 335R, 335L may also contain one or more flap holes 336 for receiving a marker or other writing instrument. The marker may be inserted into the flap holes 336 so that the marker rests at an incline on the second support ledge 360. An additional flap hole (not shown) could optionally be formed in stabilizing flap 335L to hold the marker in a substantially horizontal position. In such a case, the marker is inserted through a first flap hole 336 in stabilizing flap 335R and through second flap hole (not shown) in stabilizing flap 335L. As shown in FIGS. 5 and 6A, the flap hole 336 in stabilizing flap 335R also functions as the complementary opening 52*b* adapted to receive a support peg for hanging the easel pad 10.

Again, it will be appreciated by those skilled in the art that the blank 300 can be formed in any suitable cover 30. Preferably, the blank 300 is formed in an easel pad 10 having a cover 30 comprising both a bottom cover panel 32 and a front cover panel 34, rather than a single panel. In such a case, the blank is most preferably formed in the front cover panel 34. When the easel pad is placed in an upright position, the bottom cover panel 32 provides a vertical wall behind the front cover panel 34 in the area in which the second support ledge 360 extends substantially perpendicularly from the plane of the front cover panel 34. Thus, the bottom cover panel 32 helps prevent the marker or other writing instrument from rolling backwards off the support ledge 360.

Fourth Embodiment

Figure 7:
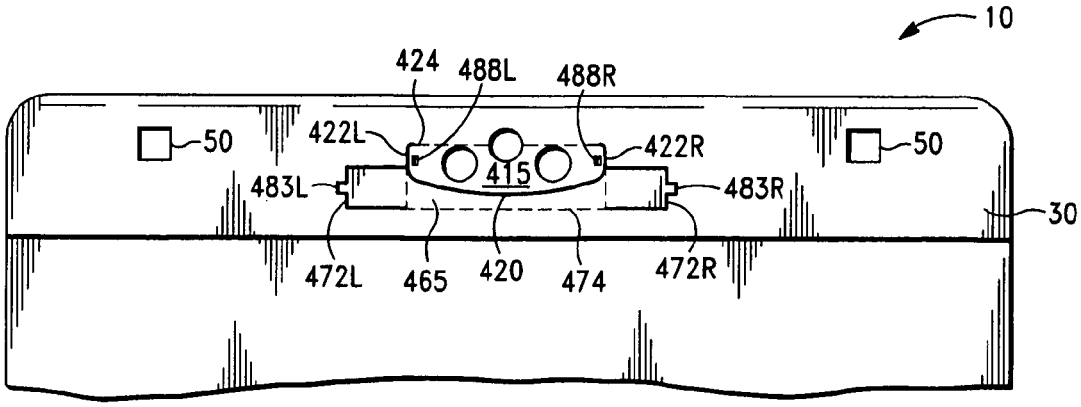
FIG. 7 is a plan view of the top portion of an easel pad having a die-cut pattern in the easel pad cover in accordance with a fourth embodiment of the present invention.
Figure 8:
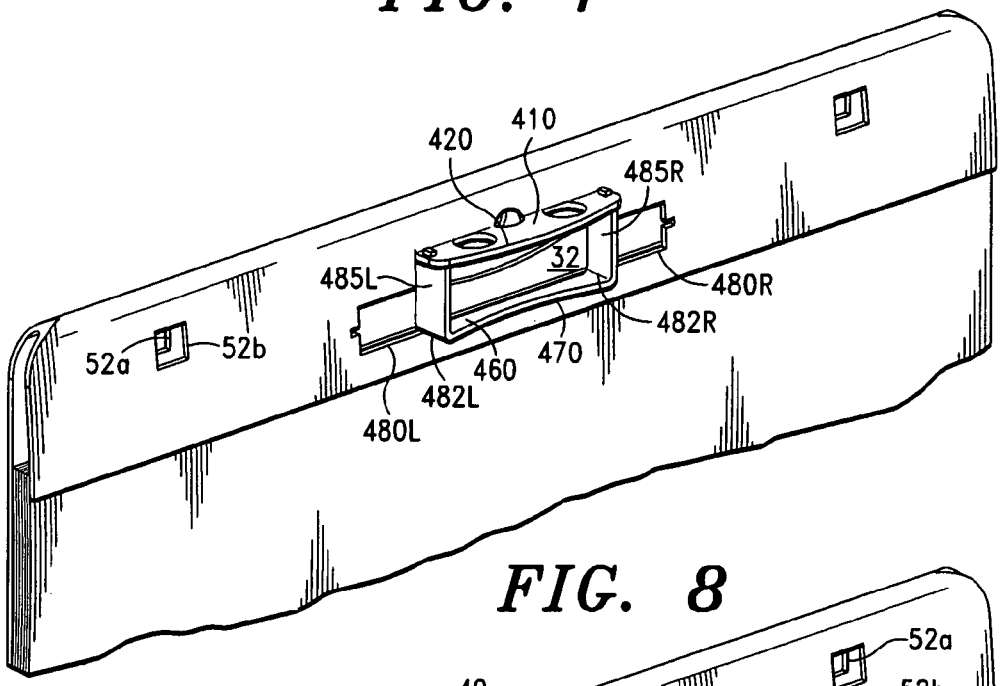
Figure 8A:
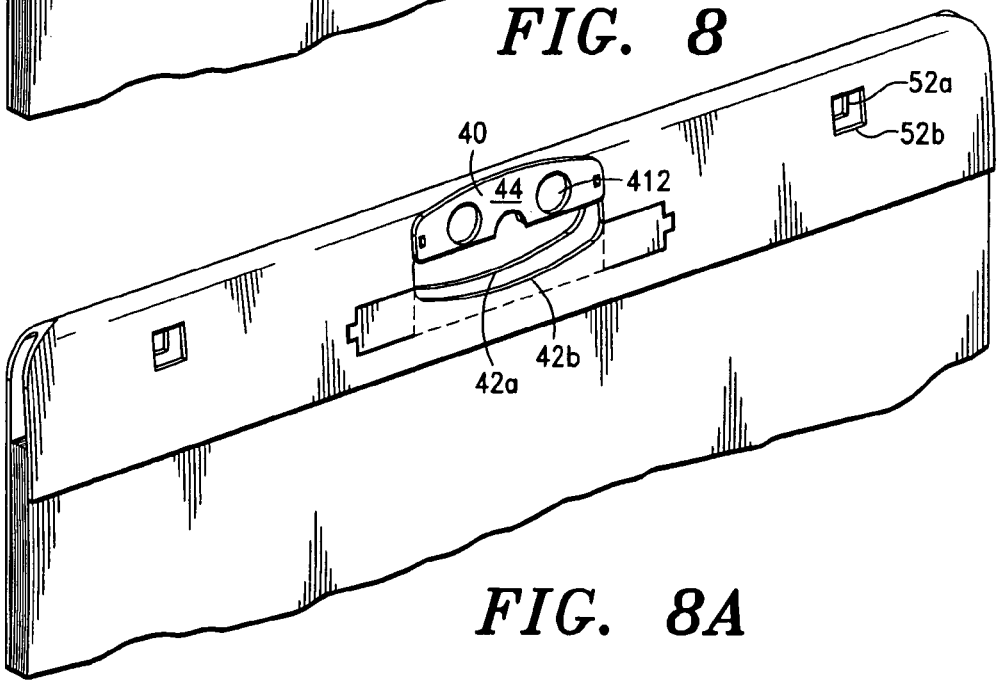
FIG. 8A is another front perspective view of easel pad shown in FIG. 7, whereby the front cover panel is folded to create a handle in the easel pad.

FIGS. 7, 8, and 8A illustrate an easel pad 10 in accordance with a fourth embodiment of the present invention. The easel pad 10 comprises a stack of flexible sheets 20 and a cover 30 having both a bottom cover panel 32 and a front cover panel 34. As shown in FIG. 8A, the cover 30 also contains a handle 40 comprised of a pair of complementary handle openings 42*a*, 42*b*, in which the bottom complementary handle opening 42*a* is an elongated slot in the bottom cover panel 32 and the front complementary handle opening 42*b* is a foldable flap 44 in the front cover panel 34. In addition, the cover 30 includes two lateral hanging openings 50 comprised of complementary hanging openings 52*a*, 52*b* (e.g., holes) adapted to receive hanging pegs or hooks.

FIG. 7 shows a blank 400 for creating a support ledge 410 in accordance with the fourth embodiment of the present invention. The support ledge 410 comprises a flap 415 of any suitable shape or size. The flap 415 is preferably formed by making a generally "u"-shaped cut in the cover 30. The flap 415 has an upper fold-line 424, two side cuts 422R, 422L, and a lower cut 420. When the flap 415 is folded upwardly along upper fold-line 424 so that flap 415 is substantially perpendicular to the plane of the cover 30, it forms a support ledge 410 for holding a marker or other writing instrument (see FIG. 8). Thus, when the easel pad 10 is placed in an upright position, the user can easily access the marker from the support ledge 410.

In the fourth embodiment, the blank 400 optionally contains additional cuts and/or folds used to create a second support ledge 460 below the support ledge 410. Although the first support ledge 410 and second support ledge 460 can be formed with independent cuts and folds, the blank 400 preferably integrates the second ledge 460 with the die-cut pattern of the first support ledge 410. That is, at least one of the cuts and/or folds that is used to form the first support ledge 410 is also used to form part of the second support ledge 460.

The second ledge 460 is generally constructed in a similar way to the ledge 110 discussed above in conjunction with the first embodiment. More specifically, the flap 465 comprises an upper cut 470, two side cuts 472R, 472L, and a lower fold-line 474. That is, the flap 465 is formed by making a generally upside-down "u"-shaped cut in the cover 30. At least a portion of the cut used to form the bottom of the upside-down "u" for flap 465 comprises a portion of the lower cut 420 used to form flap 415 so that the first support ledge 410 and second support ledge 460 are integrally formed together.

As shown in FIG. 7, the lower fold-line 474 is substantially horizontal when the easel pad is in a substantially upright or vertical position. When the flap 465 is folded downwardly along lower fold-line 474 so that flap 465 is substantially perpendicular to the plane of the substantially vertical cover 30 (see FIG. 8), it forms a substantially horizontal support ledge 460 for holding a marker or other writing instrument, which can be easily accessed by the user.

The blank 400 preferably contains additional cuts and/or folds that are used to stabilize the support ledge 410 and/or support ledge 460. For example, adjacent or near the lower fold-line 474, one or more lower cuts 480R, 480L are provided. When the cover is folded along fold-line 482R (which extends between the lower fold-line 474 of lower flap 465 and the lower cut 420 of upper flap 415), the blank creates a foldable stabilizing flap 485R. To help stabilize the support ledge 460, the flap 485R is folded out along fold-line 482R so that the flap extends out of the plane (e.g., substantially perpendicularly) from the cover 30. The flap 485R engages the cover 30 to help maintain the support ledge 460 in a removably fixed position. The flap 485R may contain a notch 483R for removable insertion into a receiving slot 488R in the cover 30 for additional stability.

Similarly, when the cover is folded along fold-line 482L (which extends between the lower fold-line 474 of lower flap 465 and the lower cut 420 of upper flap 415), the blank creates a stabilizing flap 485L opposite to the stabilizing flap 485R. To help stabilize the ledge 460, the flap 485L is folded out along fold-line 482L so that the flap 485R is no longer in the same plane as the cover 30. The flap 485L engages the cover 30 to help maintain the support ledge 460 in a removably fixed position. The flap 485L also preferably contains a notch 483L for insertion into receiving slot 488L in the cover 30 for additional stability.

As shown in FIG. 8, the flaps 485R, 485L are preferably inserted into receiving slots 488R, 488L in the first ledge 410 for additional stability. Thus, the blank 400 comprises one or more flaps which function to stabilize both the first support ledge 410 and the second support ledge 460.

In addition, the blank 400 comprises a handle 40 that is integrated with the die-cut pattern of the support ledge 410. That is, at least one of the cuts and/or folds that is used to form the support ledge 410 also forms part of the handle 40.

More specifically, the flap 415 for forming support ledge 410 also functions as a handle 40. That is, the foldable flap 415 which is used to form the support ledge 410 can be folded upwardly so that it is positioned either: (1) against the bottom cover panel in a plane substantially parallel to the bottom cover panel 32 (see generally FIG. 4A), or (2) against the front cover panel in a plane substantially parallel to the front cover panel 34 (see FIG. 8A). When folded, the flap creates complementary handle opening 42*b*. The bottom cover panel 32 contains a complementary handle opening 42*a* which at least partially overlaps complementary handle opening 42*b* in the front cover panel. It is preferable that the complementary handle opening 42*a* in the bottom cover panel be sized and shaped such that the bottom cover panel 32 creates at vertical wall behind the front cover panel 34 in the area in which the support ledge 460 extends substantially perpendicularly from the plane of the easel pad (see FIG. 8). Thus, the bottom cover panel 32 helps prevent the marker or other writing instrument from rolling off the support ledge 460.

As shown in the figures, the first ledge 410 contains one or more holes 412 for removably receiving a writing instrument or other elongated object in a substantially vertical position. In addition, it will be readily appreciated that although not shown, the second ledge 460 and/or stabilizing flaps 485R, 485L may also contain holes for receiving a writing instrument as generally set forth in the fourth embodiment.

Fifth Embodiment

Figure 9:
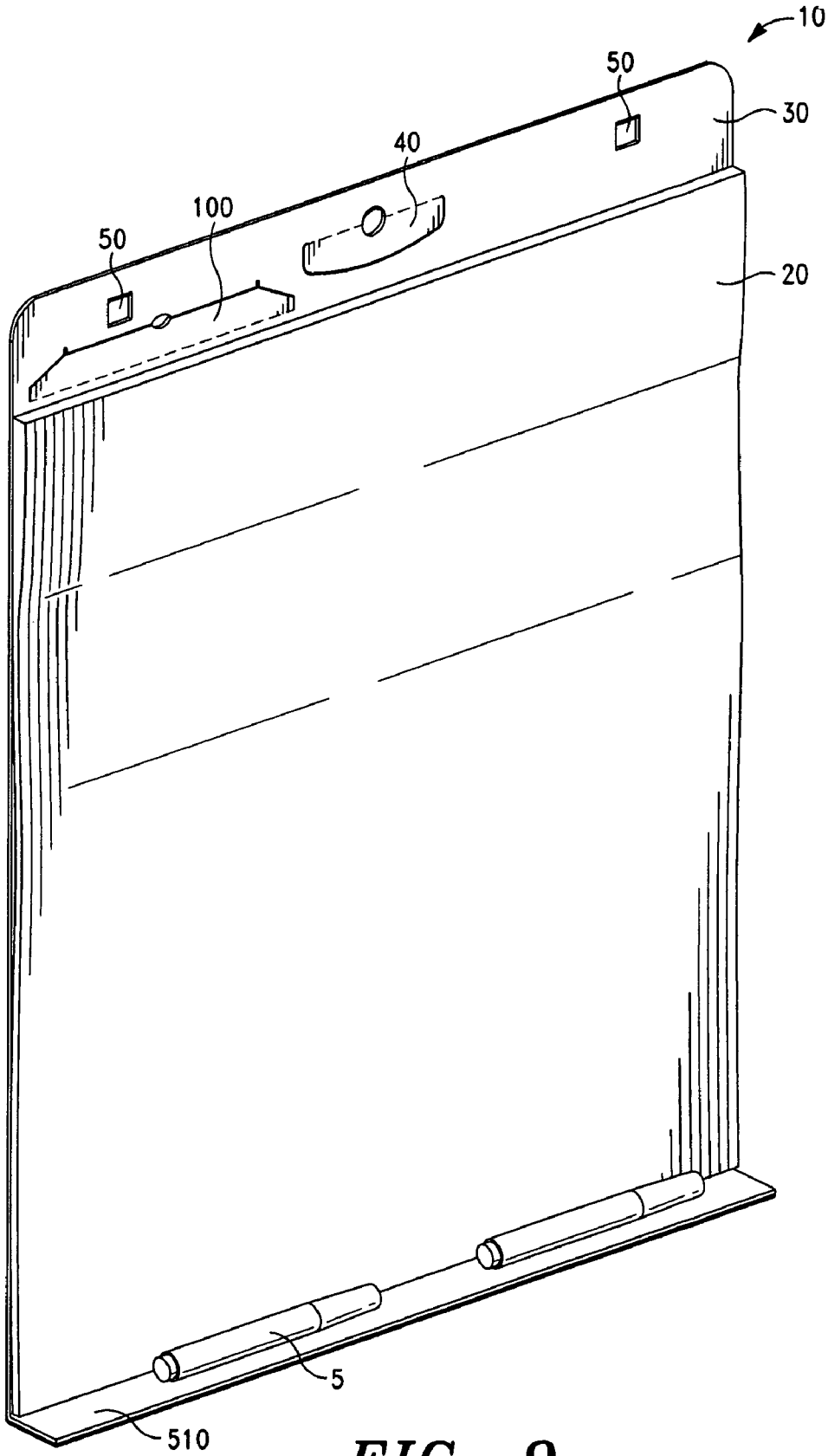
FIG. 9 is a front perspective view of an easel pad having a die-cut pattern in the easel pad cover in accordance with a fifth embodiment of the present invention.
Figure 10:
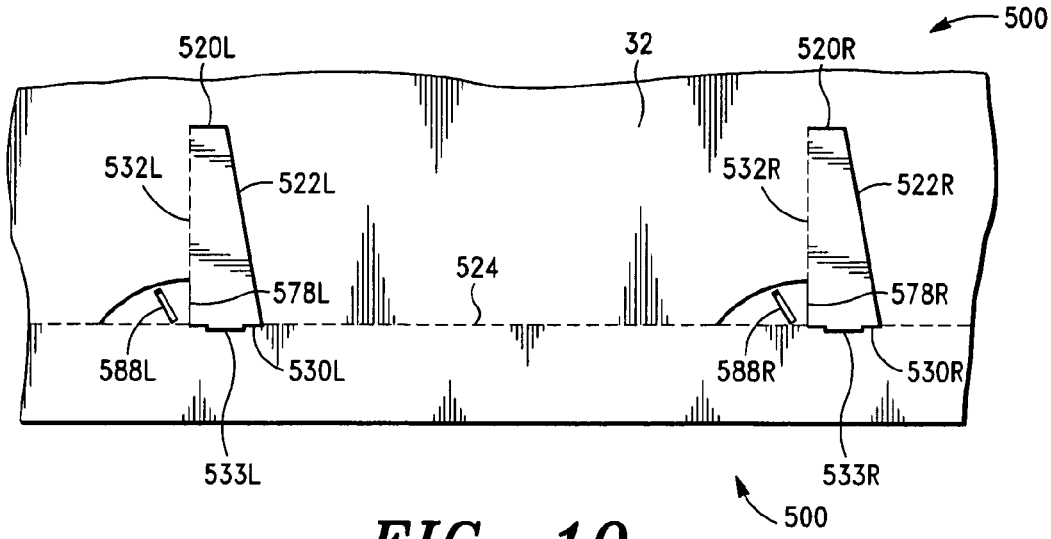
FIG. 10 is an enlarged back plan view of a portion of the bottom cover panel of the easel pad, whereby the bottom cover panel contains a die-cut pattern for forming and stabilizing the ledge illustrated in FIG. 9.
Figure 11:
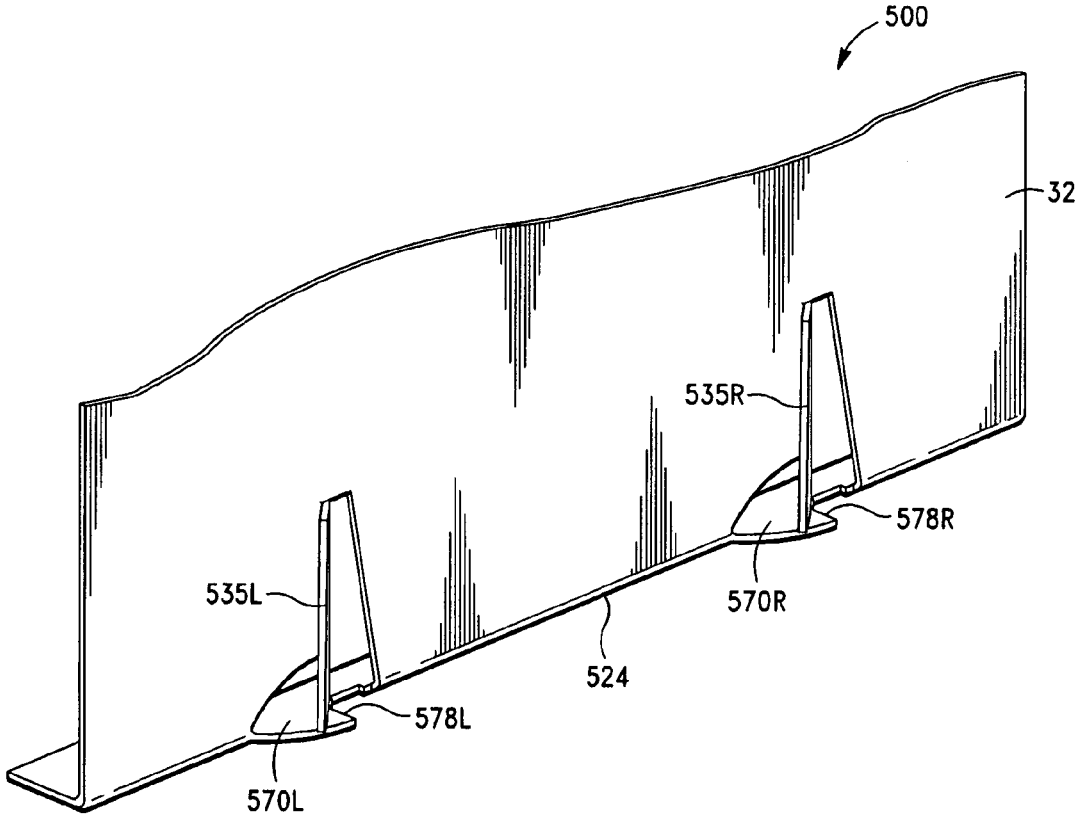
FIG. 11 is an enlarged back perspective view of the portion of the easel pad shown in FIG. 9, illustrating a stabilizing flap and flange.
Figure 12:
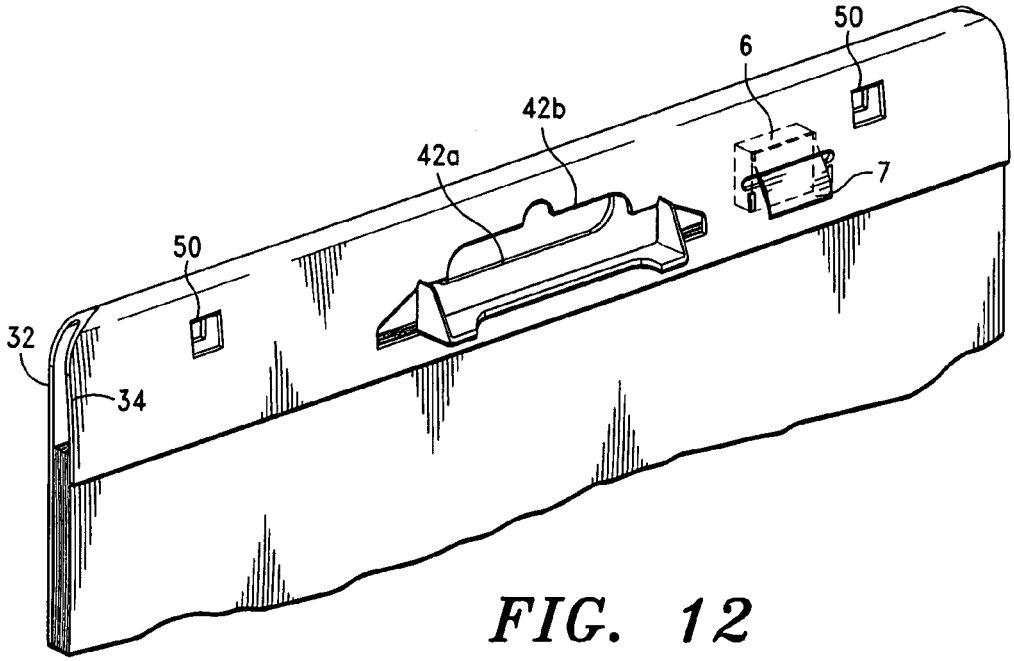
FIG. 12 is a front perspective view of an easel pad having a die-cut pattern in the easel pad cover in accordance with a sixth embodiment of the present invention, in which a small note pad is positioned between the front and bottom cover panels.
Figure 13:
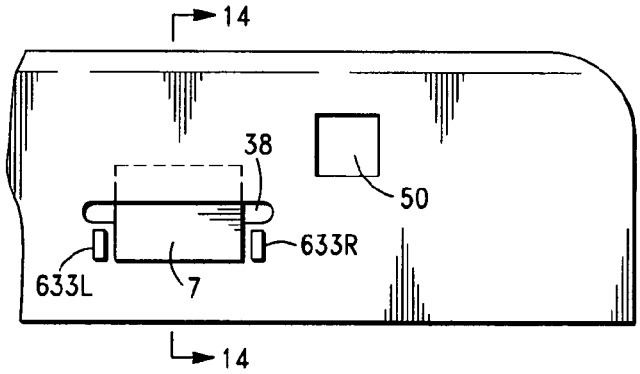
FIG. 13 is an enlarged top plan view of a portion of the easel pad cover shown in FIG. 12.

FIGS. 9, 10 and 11 illustrate an easel pad 10 with a support ledge 510 in accordance with a fifth embodiment of the present invention. The easel pad 10 comprises a stack of flexible sheets 20 and a cover 30 comprising a bottom cover panel 32, a handle 40 comprised of a foldable flap in the bottom cover panel 32. In addition, the cover 30 includes two lateral hanging openings 50 adapted to receive hanging pegs or hooks.

In the fifth embodiment, the bottom cover panel 32 of the cover 30 extends below the stack of flexible sheets 20. The bottom cover panel 32 is folded below the stack of flexible sheets near the lower margin along fold-line 524. The fold-line 524 preferably traverses the entire width of the cover 30. The support ledge 510 is formed by folding the bottom cover panel 32 upwardly at the fold-line 524 so that the support ledge 510 extends outwardly from, and preferably substantially perpendicular to the plane of the cover 30 or at an upward angle, thereby making a "v" with the cover. As such, when the easel pad 10 is in a substantially upright or vertical position, the support ledge 510 is in a substantially horizontal plane so that the support ledge is well-adapted for holding a marker or other writing instrument, which can be easily accessed by the user. The support ledge 510 may optionally contain a lip (not shown) that extends upward to help keep the writing instrument from rolling off the support ledge 510.

The blank 500 for forming the support ledge 510 preferably contains additional cuts and/or folds that are used to stabilize the support ledge 510. For example, as shown in FIGS. 10 and 11, one or more stabilizing flaps 535R, 535L are provided in the blank 500. The stabilizing flaps 535R, 535L are any suitable size and shape, but are preferably comprised of generally sideways "u"-shaped cuts in the cover 30. More specifically, a lower cut 530R is provided near fold-line 524. Above fold-line 524 is a side cut 522R, upper cut 520R, and a side fold-line 532R (which extends from upper cut 520R toward the fold-line 524). To help stabilize the support ledge 510, the bottom cover panel 32 is folded out along side fold-line 532R to form stabilizing flap 535R. The stabilizing flap 532R preferably forms between about a 30 to 90 degree angle with the plane of the bottom cover panel 32, and most preferably between about a 50 to 70 degree angle with the plane of the cover.

The stabilizing flap 535R engages a stabilizing flange 570R formed from the blank 500 in the bottom cover panel 32. The stabilizing flange 570R is preferably integrated with the stabilizing flap 535R. That is, at least one of the cuts and/or folds that is used to form the stabilizing flange 570R also forms part of the stabilizing flap 535R. For example, as shown in FIGS. 10 and 11, the stabilizing flange 570R comprises a generally upside down "u"-shaped cut in the bottom cover panel 32. The stabilizing flange 570R includes a side cut 578R which extends between the side fold-line 532R and the lower cut 530R of the stabilizing flap 535R. The stabilizing flap 535R preferably contains a notch 533R which is removably inserted into a receiving slot 588R in the stabilizing flange 570R for additional stability.

In use, the support ledge 510 and the stabilizing flange 570R are preferably in the same plane but extend outwardly from the plane of the cover 30 in opposite directions. Specifically, as shown in FIG. 11, the support ledge 510 extends out toward the front of the easel pad 10, while the stabilizing flange 570R extends out toward the bottom of the easel pad 10.

Stabilizing flap 535L is formed in a similar fashion. A lower cut 530L is provided along or just below lower fold-line 524. Above fold-line 524 is a side cut 522L, upper cut 520L, and a side fold-line 532L (which extends from upper cut 520L toward the fold-line 524). To help stabilize the support ledge 510, the bottom cover panel 32 is folded out along side fold-line 532L to form the stabilizing flap 535L. The stabilizing flap 532 forms between about a 30 to 90 degree angle with the plane of the bottom cover panel 32, and most preferably between about a 50 to 70 degree angle with the plane of the cover.

The stabilizing flap 535L engages a stabilizing flange 570L formed from the blank 500 in the bottom cover panel 32. The stabilizing flange 570L is preferably integrated with the stabilizing flap 535L. That is, at least one of the cuts and/or folds that is used to form the stabilizing flange 570L also forms part of the stabilizing flap 535L. The stabilizing flange 570L comprises a generally upside down "u"-shaped cut in the bottom cover panel 32. The stabilizing flange 570L includes a side cut 578L which extends between the side fold-line 532L and the lower cut 530L of the stabilizing flap 535L. The stabilizing flap 535L preferably contains a notch 533L which is removably inserted into a receiving slot 588L in the stabilizing flange 570L for additional stability.

The support ledge 510 and the stabilizing flange 570L are preferably in the same plane but extend outwardly from the plane of the cover 30 in opposite directions. The support ledge 510 extend up towards the front of the easel pad 10, while the stabilizing flange 570L extends down towards the bottom of the easel pad 10.

Sixth Embodiment

FIGS. 12, 13, 14, and 15 illustrate an easel pad 10 with a support ledge 610 in accordance with a sixth embodiment of the present invention. In this embodiment, the support ledge 610 is adapted for holding a separate smaller pad 6 of flexible sheets so that the sheets 7 can be easily accessed by the user/drawer when using the easel pad 10.

More specifically, the support ledge 610 comprises the edge of the stack of flexible sheets, which is positioned between the bottom cover panel 32 and the front cover panel 34 of the cover 30. An opening, such as an elongated slot 38, is formed in at least one of either the bottom cover panel 32 or the front cover panel 34 of the cover, most preferably the front cover panel 34. The separate pad 6 of flexible sheets is positioned between the bottom cover panel 32 and the front cover panel 34 of the cover 30 so that at least one sheet in the separate pad 6 extends through the slot 38 in the cover 30. The support ledge 610 helps keep the separate pad 6 in a fixed position between the bottom cover panel 32 and front cover panel 34 of the cover 30.

The separate pad 6 of sheets can be made of any suitable material and can be any suitable shape and size. Such pads are well-known in the art, and are commercially available by various manufacturers.

Figure 14:
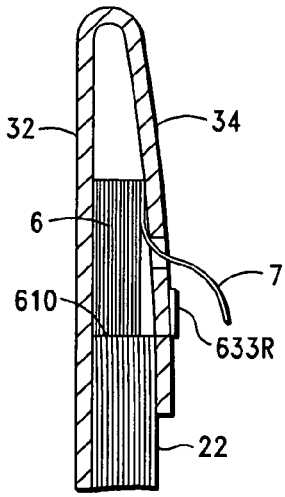
FIG. 14 is a cross-sectional view of the easel pad and separate pad shown in FIG. 13 taken through line 14-14.

Typically, the pad 6 comprises a stack of rectangular-shaped flexible sheets 7 comprised of paper. Each has a first major surface and an opposite second major surface extending between two substantially opposite edges. Each sheet has repositionable adhesive along one edge and is free of adhesive along the opposite edge. The sheets are stacked with the repositionable adhesive edge of each sheet disposed along alternate opposite edges to maintain the sheets in the stack. Such pads 6 are generally described in U.S. Pat. Nos. 5,417,345 and 6,669,992, which are incorporated by reference. As generally shown in FIG. 14, the sheets 7 are preferably dispensed one at a time from the slot 38 in the cover 30 of the easel pad 10, the top sheet of the note pad 6 designed to be easily removed from the note pad, and at the same time pull the adjacent sheet through the slot 38.

Figure 15:
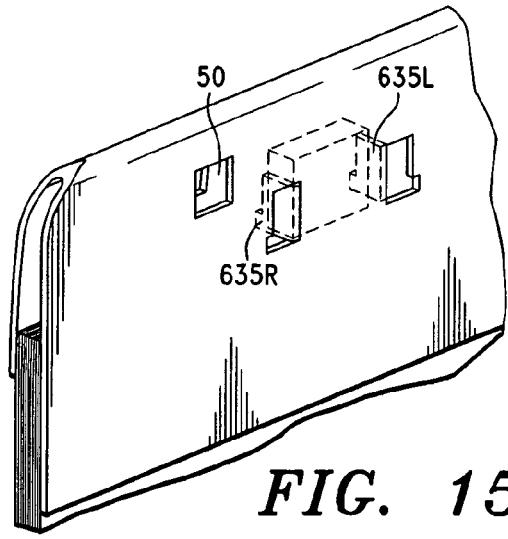
FIG. 15 is a back perspective view of a portion of the easel pad shown in FIG. 12, showing the positioning of the small note pad between the bottom cover panel and front cover panel and stabilizing flaps in the bottom cover panel.
Figure 16:
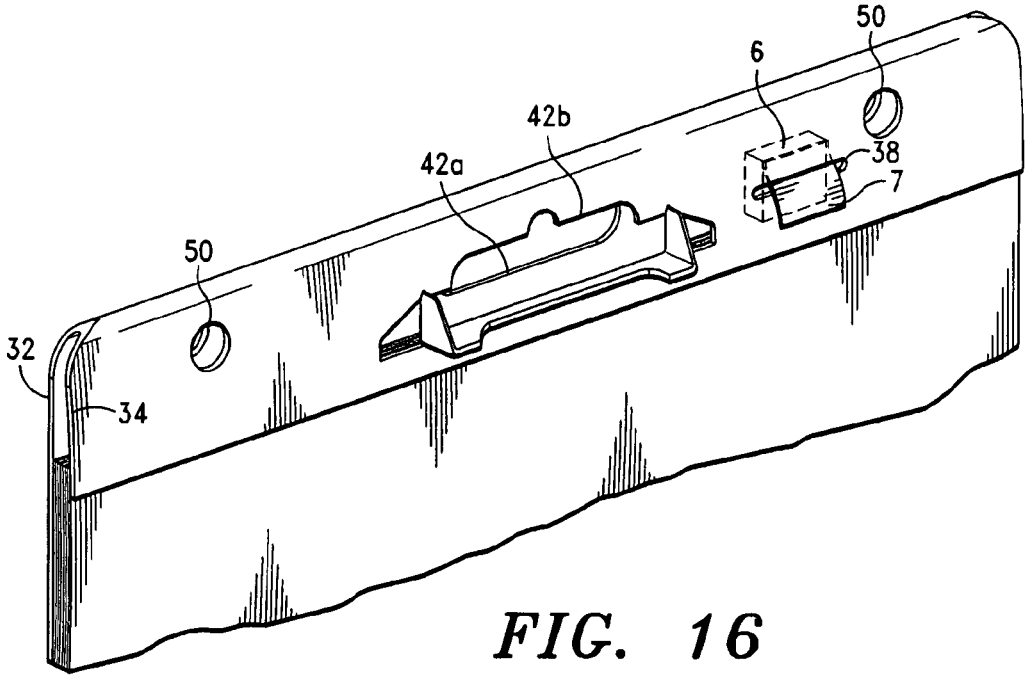
FIG. 16 is a front perspective view of an easel pad having a die-cut pattern in the easel pad cover in accordance with a seventh embodiment of the present invention, in which a small note pad is positioned between the front and bottom cover panels.

The cover 30 may also contain additional cuts and/or folds to help stabilize the pad 6 on the support ledge 610 between the bottom cover panel 32 and front cover panel 34. For example, FIG. 15 illustrates two stabilizing flaps 635R, 635L that are die-cut into the bottom cover panel 32. Each stabilizing flap 635R, 635L extends from the bottom cover panel 32 and is positioned on one side of the note pad 6 to help retain the note pad 6 within the cover. The fold-line for each flap 635R, 635L is located more centrally than the more laterally positioned "u"shaped cut of the flaps 635R, 635L relative to the pad 6. The stabilizing flaps 635R, 635L each preferably contain a notch 633R, 633L for removably engaging a corresponding receiving opening (e.g., slot) in the front cover 34.

Seventh Embodiment

FIGS. 16, 17, 18, and 19 illustrate an easel pad 10 with a support ledge 710 in accordance with a seventh embodiment of the present invention. This embodiment is similar to the sixth embodiment except that the support ledge 710 adapted for holding a separate smaller pad 6 is formed from the cover 30, instead of the edge of the stack of flexible sheets 20. The easel pad 10 is die-cut so that the sheets 7 of the smaller pad 6 can be easily accessed by the user/drawer when using the easel pad 10.

More specifically, the support ledge 710 comprises a flap 715 formed by making a generally upside-down "u"-shaped cut in the bottom cover panel 32 of the cover 30. As shown in the figures, the lower fold-line 724 is substantially horizontal when the easel pad is in a substantially upright or vertical position. When the flap 715 is folded downwardly along lower fold-line 724 so that the flap 715 is substantially perpendicular to the plane of the upright cover 30, it forms a horizontal support ledge 710 for holding the pad between the front cover panel 34 and bottom cover panel 32 of the cover. An opening, such as an elongated slot 38, is formed in the front cover panel 34. At least one sheet in the separate pad 6 extends through the slot 38 in the cover 30.

Figure 18:
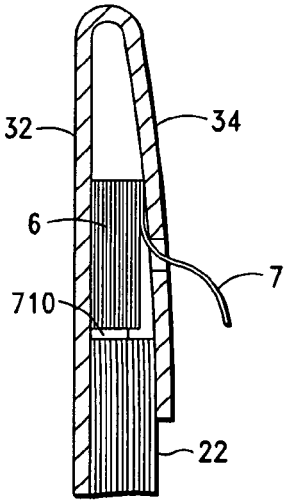
FIG. 18 is a cross-sectional view of the easel pad and separate pad shown in FIG. 17 taken through line 18-18.

The support ledge 710 extends at least partially between the gap created between the bottom cover panel 32 and the front cover panel 34 (see FIG. 18). Alternatively, the support ledge 710 may traverse the entire gap between the bottom cover panel 32 and the front cover panel 34. The support ledge 710 may also contain a notch for removably engaging a corresponding slot (not shown) in the front cover panel 34.

Figure 17:
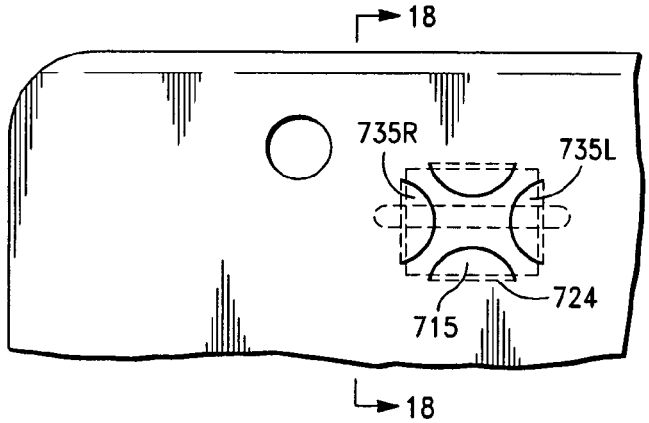
FIG. 17 is an enlarged bottom plan view of a portion of the easel pad cover shown in FIG. 16.
Figure 19:
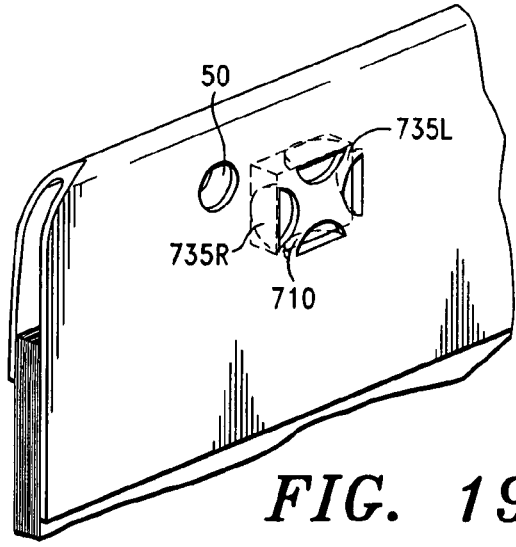
FIG. 19 is a back perspective view of a portion of the easel pad shown in FIG. 16, showing the positioning of the small note pad between the bottom cover panel and front cover panel and stabilizing flaps in the bottom cover panel.

The cover 30 may also contain additional cuts and/or folds to help stabilize the pad 6 on the support ledge 710 between the bottom cover panel and front cover panel. For example, FIGS. 17 and 19 illustrate two stabilizing flaps 735R, 735L that are die-cut into the bottom cover panel 32. Each stabilizing flap 735R, 735L extends from the bottom cover panel 32 and is positioned on one side of the note pad 6 to help retain the note pad 6 within the cover. In contrast to the stabilizing flaps 635R, 635L shown in the sixth embodiment, the fold-line for each flap 735R, 735L is located more laterally than the more centrally positioned "u"-shaped cut of the flaps 735R, 735L relative to the pad 6. The stablizing flaps 735R, 735L may optionally engage an opening (not shown) in the front cover panel to help secure the flaps 735R, 735L in a removably fixed position.

Eighth Embodiment

Figure 20:
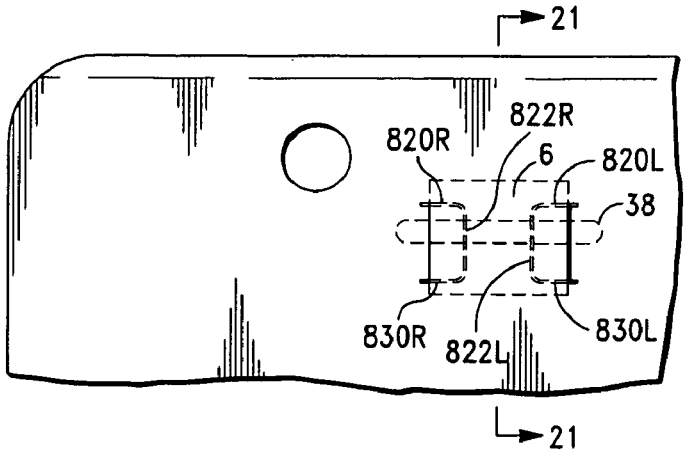
FIG. 20 is an enlarged bottom plan view of a portion of an easel pad having a die-cut pattern in the easel pad cover in accordance with an eighth embodiment of the present invention, in which a small note pad is positioned between the front and bottom cover panels.
Figure 21:
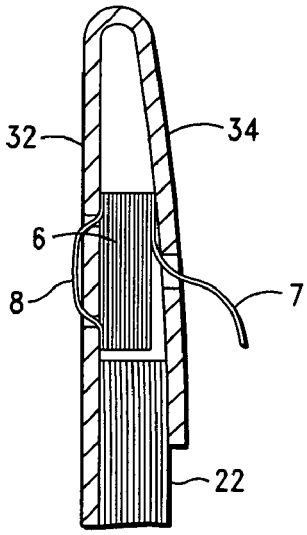
FIG. 21 is a cross-sectional view of the easel pad and separate pad shown in FIG. 20 taken through line 21-21.
Figure 22:
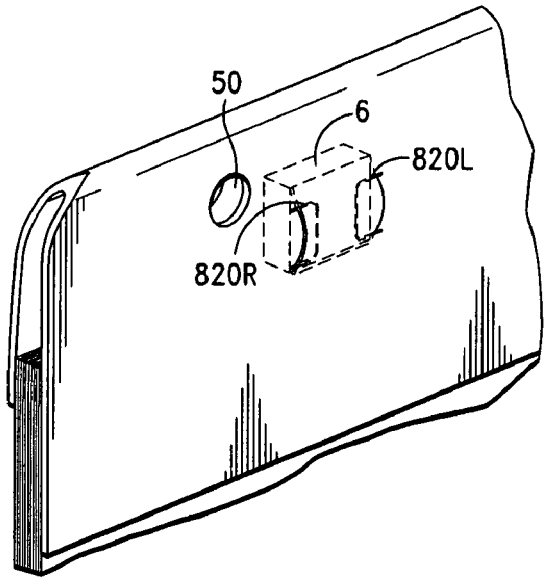
FIG. 22 is a back perspective view of a portion of the easel pad shown in FIG. 20, showing the positioning of the small note pad between the bottom cover panel and front cover panel using a cut in the bottom cover panel.

FIGS. 20, 21, and 22 illustrate an easel pad 10 with in accordance with an eighth embodiment of the present invention. This embodiment is similar to the sixth and seventh embodiments insofar as a separate smaller pad is retained within the cover. In the eighth embodiment, however, that there is no support ledge holding the separate smaller pad 6. Instead, the smaller pad 6 is positioned within the cover 30 by removably or permanently positioning the bottommost sheet 8 of the pad 6 in or against the bottom panel 32 of the cover in a fixed position.

More specifically, the bottommost sheet in the pad 6 may be secured to the cover 30 using adhesive, staples, tape, and the like (not shown). As such, the pad 6 is retained in a permanently fixed position between the bottom cover panel 32 and the front cover panel 34.

As another example, as illustrated in the drawings, the bottom cover panel 32 contains one or more cuts through which the bottommost sheet of the pad 6 is removably secured to the bottom cover panel 32. Most preferably, there are at least two cuts in the bottom cover panel 32. For example, FIG. 20 illustrates a right cut (comprising right top cut 820R, right side cut 822R, and right bottom cut 830R) and a left cut (comprising left top cut 820L, left side cut 822L, and left bottom cut 830L). As shown in FIG. 21, the bottommost sheet 8 of the pad 6 is positioned through the top cuts 820R, 820L and then down along the side cuts 822R, 822L and then through the bottom cuts 830R, 830L. Thus, a set of right and left "u"-shaped cuts are formed in the bottom cover panel 32 which operate to retain the separate pad 6 against the bottom cover panel 32 in a removably fixed position. The bottommost sheet 8 is essentially threaded through the various cuts to maintain the separate pad 6 in a removably fixed position. Because the bottommost sheet 8 is secured to the remainder the sheets in the pad (e.g., by virtue of adhesive or other conventional binding techniques), the entire pad 6 is retained and positioned within the cover 30. As with the sixth and seventh embodiments, an opening, such as an elongated slot 38, is formed in the front cover panel 34. At least one sheet in the separate pad 6 extends through the slot 38 in the cover 30.

It will be readily appreciated that the bottommost sheet 8 may comprise a sheet member of the smaller stack 6 of flexible sheets or a different sheet material (e.g., a backer or release material commonly used with note pads). In addition, more than one sheet in the pad 6 may be positioned through the various cut(s) in the bottom cover panel to removably secure the pad 6 to the cover.

It will be also appreciated that the separate pad 6 could be maintained within the pad using a variety of cut patterns in the bottom cover panel 32, in addition to those illustrated in the drawings. For example, the bottommost sheet 8 could simply be placed through a single substantially horizontal cut in the bottom cover panel 32 that is equal to or slightly longer than the width of the separate pad The bottommost sheet 8 could then optionally be place through another single substantially horizontal cut on the bottom cover panel that is positioned below the first horizontal cut.

While specific embodiments have been shown and discussed, various modifications may of course be made, and the invention is not limited to the specific forms or arrangement of parts and steps described herein, except insofar as such limitations are included in the following claims. For example, in view of this disclosure, it will be readily apparent to one skilled in the art how the die-cut patterns are well suited for construction in easel pads having a cover comprising a bottom cover panel (e.g., one which extends above the stack of flexible sheets) or a cover comprising both a bottom cover panel and front cover panel. Further, it will be understood that certain features and sub-combinations are of utility and may be employed without reference to other features and sub-combinations. This is contemplated by and is within the scope of the claims.

What is claimed and desired to be secured by Letters Patent is as follows:

1. An easel pad comprising:

a stack of flexible sheets each of said sheets having a front surface and a back surface positioned in a first major plane;

a cover extending in said first major plane and integrally formed with said stack of flexible sheets to cover at least a portion of the front surface of a top sheet in said stack of flexible sheets or a portion of the back surface of a bottom sheet in said stack of flexible sheets, said cover extending above an upper edge of said stack of flexible sheets; and a first ledge that defines a ledge surface extending outwardly from said cover substantially perpendicular to said first major plane such that when the front top surface of said sheets is positioned in a substantially vertical upright position, said ledge surface defines a substantially horizontal surface adapted to support an instrument resting thereon.

2. The easel pad of claim 1 wherein said first ledge is integrally formed in said cover, and said ledge comprises a flap in said cover, said flap extending outwardly from said cover substantially perpendicular to said first major plane.

3. The easel pad of claim 2 wherein said flap comprises a generally "u"-shaped cut in said cover.

4. The easel pad of claim 3 wherein said generally "u"-shaped cut comprises a lower fold-line, a left side cut, a right side cut, and an upper cut, and wherein at least one additional cut is made laterally to said lower fold-line, and wherein said cover is folded between said lower fold-line and said upper cut at said additional cut to form a stabilizing flap, said stabilizing flap engaging said first ledge in a removably fixed position.

5. The easel pad of claim 1 wherein said first ledge is stabilized by a stabilizing flap formed in and extending from said cover.

6. The easel pad of claim 5 where said stabilizing flap contains a flap hole.

7. The easel pad of claim 1 wherein said first ledge is integrated with a handle in said easel pad.

8. The easel pad of claim 7 wherein said first ledge comprises a flap formed in said cover, said flap comprising a cut in said cover, and wherein at least a portion of said cut is also used to form said handle.

9. The easel pad of claim 8 wherein said handle comprises an opening in said cover, said opening formed in part from said cut, and said opening is selected from the group consisting of a hole in said cover or a flap in said cover.

10. The easel pad of claim 1 further comprising a second ledge extending outwardly from said cover, said second ledge positioned below said first ledge.

11. The easel pad of claim 10 wherein said first ledge is integrated with said second ledge such that at least one cut in said cover used to form said first ledge is also used to form said second ledge.

12. The easel pad of claim 11 wherein a stabilizing flap extends out from said first major plane to stabilize said first ledge in a removably fixed position.

13. The easel pad of claim 12 wherein said stabilizing flap also stabilizes said second ledge.

14. The easel pad of claim 13 wherein said stabilizing flap removably engages said second ledge in a removably fixed position.

15. The easel pad of claim 12 wherein said stabilizing flap is removably inserted in a slot in said cover.

16. The easel pad of claim 1 wherein said cover comprises a bottom cover panel and a front cover panel, and wherein said first ledge extends outwardly from said front cover panel, said first ledge comprising a foldable flap which creates an opening in said front cover panel, and wherein said bottom cover panel covers at least a portion of said opening, thereby preventing a rollable object from rolling off said first ledge toward said bottom cover panel when said easel pad is in an upright position.

17. The easel pad of claim 1 wherein said stack of flexible sheets has a top edge, and wherein said stack of flexible sheets is positioned on said cover so that said top edge of said stack of flexible sheets is aligned with said first ledge to form a composite ledge comprising said first ledge and said top edge of said stack of flexible sheets.

18. The easel pad of claim 1 wherein said cover comprises a bottom cover panel upon which said stack of flexible sheets is attached, and wherein said bottom cover panel extends beyond an edge of said stack of flexible sheets, and wherein said bottom cover panel is folded adjacent said edge of said stack of flexible sheets along a fold-line to form said first ledge for supporting a writing instrument.

19. The easel pad of claim 18 wherein said bottom cover panel extends beyond a lower edge of said stack of flexible sheets and wherein said fold-line traverses the entire width of said cover.

20. The easel pad of claim 18 wherein said first ledge is stabilized by a stabilizing flap extending from said cover.

21. The easel pad of claim 20 wherein said stabilizing flap is removably inserted into a slot in a stabilizing flange extending from said cover.

22. The easel pad of claim 21 wherein said first ledge and said stabilizing flange are in the same plane but extend outwardly said cover in opposite directions.

23. The easel pad of claim 1 wherein said instrument to be used with said easel pad is selected from the group consisting of a writing instrument or an eraser.

* * * * *